US006860780B2

(12) United States Patent
Miyashita et al.

(10) Patent No.: US 6,860,780 B2
(45) Date of Patent: Mar. 1, 2005

(54) HIGHLY PRODUCTIVE METHOD OF PRODUCING PLASMA DISPLAY PANEL

(75) Inventors: Kanako Miyashita, Moriguchi (JP); Hiroyuki Kado, Ibaraki (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 0 days.

(21) Appl. No.: 09/827,027

(22) Filed: Apr. 4, 2001

(65) Prior Publication Data

US 2002/0024295 A1 Feb. 28, 2002

(30) Foreign Application Priority Data

Apr. 4, 2000 (JP) ..... 2000-101924

(51) Int. Cl.[7] ..... H01J 9/26
(52) U.S. Cl. ..... 445/25; 445/38; 445/53
(58) Field of Search ..... 445/25, 38, 53

(56) References Cited

U.S. PATENT DOCUMENTS

| | | | | |
|---|---|---|---|---|
| 3,213,515 A | | 10/1965 | Koury et al. | |
| 3,492,598 A | | 1/1970 | Mac Nair | |
| 3,743,879 A | | 7/1973 | Kupsky | |
| 4,849,674 A | | 7/1989 | Cherry et al. | |
| 5,207,607 A | | 5/1993 | Nagano et al. | |
| 5,564,958 A | | 10/1996 | Itoh et al. | |
| 5,667,418 A | * | 9/1997 | Fahlen et al. | 445/24 |
| 5,672,083 A | * | 9/1997 | Curtin et al. | 445/25 |
| 5,674,553 A | | 10/1997 | Shinoda et al. | |
| 5,754,003 A | * | 5/1998 | Murai et al. | 313/582 |
| 6,006,003 A | | 12/1999 | Kim | |
| 6,066,922 A | * | 5/2000 | Iwasaki et al. | 313/310 |
| 6,113,450 A | * | 9/2000 | Narayanan et al. | 445/25 |
| 6,236,159 B1 | | 5/2001 | Inoue et al. | |
| 6,309,272 B1 | * | 10/2001 | Nishimura | 445/25 |
| 6,369,501 B1 | * | 4/2002 | Aoki et al. | 313/486 |

FOREIGN PATENT DOCUMENTS

| | | | | |
|---|---|---|---|---|
| EP | 779 643 | | 6/1997 | |
| FR | 2 696 867 | | 11/1993 | |
| JP | 60-55946 | | 12/1985 | |
| JP | 03077233 | | 2/1991 | |
| JP | 03035826 | | 4/1991 | |
| JP | 5234512 | | 9/1993 | |
| JP | 5-234512 | | 9/1993 | |
| JP | 11-246856 | | 9/1999 | |
| JP | 11-250804 | * | 9/1999 | H01J/9/26 |

* cited by examiner

*Primary Examiner*—Gary Paumen
*Assistant Examiner*—Edwin A. Leon

(57) ABSTRACT

A method for producing a plasma display panel that has a front substrate and a back substrate disposed to face each other. A pre-baking phosphor layer containing a phosphor and an organic binder is formed on at least one of surfaces of the front substrate and the back substrate that are to face each other. A sealing material that softens with heat is applied to the peripheral region of at least one of the surfaces of the front and back substrates that are to face each other. The front and back substrates are disposed to face each other in a stack. The front and back substrates are heated to burn out the organic binder while supplying a dry gas containing oxygen to an internal space that is formed between the front and back substrates.

35 Claims, 17 Drawing Sheets

HIGHLY PRODUCTIVE METHOD OF PRODUCING PLASMA DISPLAY PANEL

BACKGROUND OF THE INVENTION (1) Field of the Invention

The present invention relates to a method of producing a plasma display panel used as a display of a color television receiver or the like.

(2) Description of Related Art

Plasma display panels (hereinafter referred to as PDPs) have recently received attention as display apparatuses suitable for computers and televisions, being thin and light with large screens. The demand for high-definition PDPs are also increasing.

FIG. 20 is a schematic sectional view of a typical AC type PDP.

As shown in FIG. 20, a display electrode 102 is formed on a front glass substrate 101, and the display electrode 102 is covered with a dielectric glass layer 103 and a protection layer 104 that is made of magnesium oxide (MgO).

Address electrodes 106 and barrier ribs 107 are formed on a back glass substrate 105. Phosphor layers 110–112 of colors red, green, and blue are formed in spaces between barrier ribs 107.

The front glass substrate 101 and the back glass substrate 105 are formed to face each other with the barrier ribs 107 in between. Discharge spaces 109 are formed by enclosing a discharge gas into each space surrounded by the front glass substrate 101, back glass substrate 105, and barrier ribs 107.

As discharges are caused in the discharge spaces 109, vacuum ultraviolet rays (their main wavelength is 147 nm) are generated. The generated vacuum ultraviolet rays excite the phosphor layers 110–112 to emit light. This allows the PDP to display color images.

Typically, the above PDP is produced as follows.

The display electrodes 102 are formed by applying silver paste to the surface of the front glass substrate 101, and baking the applied silver paste. The dielectric glass layer 103 is formed by applying a dielectric glass paste to the surfaces of the front glass substrate 101 and display electrodes 102, and baking the applied dielectric glass paste. The protecting layer 104 is then formed on the dielectric glass layer 103.

The address electrodes 106 are formed by applying silver paste to the surface of the back glass substrate 105, and baking the applied silver paste. The partition walls 107 are formed by applying the glass paste to the surface of the layers in stripes with a certain pitch, and baking the applied glass paste.

Phosphor pastes of each color are applied to the space between the barrier ribs 107. The applied phosphor pastes are baked at approximately 500° C. to burn out organic binders (resin or the like) contained in the pastes. This completes the phosphor layers 110–112. (phosphor layer baking process)

After the phosphors are baked, a sealing material (glass frit) is applied to the outer region of the back glass substrate 105, then the applied sealing glass frit is baked at approximately 350° C. to remove resin and other elements from the applied sealing glass frit. (sealing material temporary baking process)

The front glass substrate 101 and the back glass substrate 105 are then stacked so that the display electrodes 102 are perpendicular to the address electrodes 106, the electrodes 102 facing the electrodes 106. The substrates are then bonded together by heating them to a temperature (approximately 450° C.) higher than the softening point of the sealing glass. (bonding process)

The bonded panel is heated to approximately 350° C. while gases are exhausted from inner space between the substrates (space formed between the front and back substrates, where the phosphors are exposed to the space). (exhausting process) After the exhausting process is completed, the discharge gas is supplied to the internal space to a certain pressure (typically, in a range of 300 Torr to 500 Torr).

A problem of the PDP manufactured as above is how to improve the light-emitting efficiency and the color purity.

A number of PDPs are increasingly manufactured using the above-described manufacturing method. However, the production cost of PDPs is considerably higher than that of CRTs. As a result, another problem of the PDP is how to reduce the production cost. One of many possible solutions for the cost reduction is to reduce the work (working time) and the energy consumed in several processes that require heating processes.

SUMMARY OF THE INVENTION

It is therefore the object of the present invention to provide a method of producing a plasma display panel having a high light-emitting efficiency and color purity, the method reducing electricity consumption in the production and improving productivity by reducing the heating process while preventing phosphors from being deteriorated due to heat during the production.

The above object is fulfilled by a method for producing a plasma display panel that has a front substrate and a back substrate disposed to face each other, the method comprising: a pre-baking phosphor layer forming step for forming a pre-baking phosphor layer containing a phosphor and an organic binder, on at least one of surfaces of the front substrate and the back substrate that are to face each other; a sealing material applying step for applying a sealing material that softens with heat, to the peripheral region of at least one of the surfaces of the front and back substrates that are to face each other; a stacking step for disposing the front and back substrates to face each other in a stack; and a baking step for heating the front and back substrates to burn out the organic binder while supplying a dry gas containing oxygen to an internal space that is formed between the front and back substrates.

According to the above method, the process for burning out the organic binder by heating the front and back substrates facing each other doubles the process for bonding the panels by softening the sealing material, and also doubles the process for preliminarily baking the sealing material.

The above object is also fulfilled by a method for producing a plasma display panel that has a front substrate and a back substrate disposed to face each other, the method comprising: a pre-baking phosphor layer forming step for forming a pre-baking phosphor layer containing a phosphor and an organic binder, on at least one of surfaces of the front substrate and the back substrate that are to face each other; a sealing material applying step for applying a sealing material that softens with heat, to the peripheral region of one of the surfaces of the front and back substrates that are to face each other; a baking step for burning out the organic binder by heating the front and back substrates separately disposed in a furnace; and a bonding step for disposing the front and back substrates to face each other and bonding the front and back substrates by keeping the front and back substrates being at a temperature higher than the softening point of the sealing material.

Here, the "dry gas" is a gas having a lower water vapor partial pressure than ordinary atmospheric air. Preferably, water vapor partial pressure of the dry gas is 10 Torr (1300 Pa) or lower. A typical dry gas is the air that have been subjected to a drying process (dry air).

With either of the above methods, the phosphors are baked, the organic binder is burned out, and the substrates are bonded together in one operation of raising and lowering temperature, and also the sealing material is preliminarily baked. That is to say, it is possible to perform in series the phosphor layer baking process, the sealing material preliminary baking process, and the bonding process in the same furnace. This reduces the time and energy required for the production, and reduces the number of times the phosphors are exposed to heat. As a result, deterioration of the phosphors due to heat (deterioration in light-emitting intensity and chromaticity) is suppressed.

Meanwhile, the phosphor baking process and the bonding process may be performed simultaneously by a method in which first the phosphors and sealing material are applied to one of surfaces of the front and back substrates that are to face each other, then the front and back substrates are disposed to face each other and heated.

When, however, the phosphors are baked while the front and back substrates are disposed to face each other, gases (water or the like) adsorbed on the surfaces of the substrates are released with heat and burning gases are generated, and these gases fill each narrow internal space. When this happens, deterioration of the phosphors by heat and quality change of MgO tend to happen since the phosphors and the protecting layer composed of MgO are exposed to high-temperature, high-density gases. Also, oxygen required for the burnout tends to be short. When this happens, remains of burned organic substances may be left, or MgO or the phosphors that lack oxygen may be generated. This results in decrease in discharge characteristics or light-emitting efficiency of the phosphors. Especially, chromaticity of the blue phosphors tends to be deteriorated by the heat.

In contrast, according to the first method described above, the substrates disposed to face each other are heated while a dry gas containing oxygen is circulated in the internal space. This prevents the phosphors and protecting layer from being exposed to high-temperature, high-density gases such as released gases and burning gases, suppressing deterioration of the phosphors by heat and quality change of the protecting layer.

Also, according to the second method described above, the substrates are heated while they are separated. With this arrangement, even if gases (water or the like) adsorbed on the surfaces of the substrates are released with heat, the released gases are not confined in the internal space. The heated substrates are then disposed to face each other and maintained at a temperature higher than the softening point of the sealing material so that they are bonded together. By this heating process, gases that were adsorbed on the surfaces of the substrates have been released. Therefore, in this heating process, released gases do not fill the internal space. This prevents the phosphors and protecting layer from being exposed to high-temperature, high-density gases such as released gases and burning gases, suppressing deterioration of the phosphors by heat and quality change of the protecting layer.

It is therefore possible with the above-described methods to produce PDPs having excellent light-emitting intensity and chromaticity.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENTS

<Embodiment 1>

Figure 1:
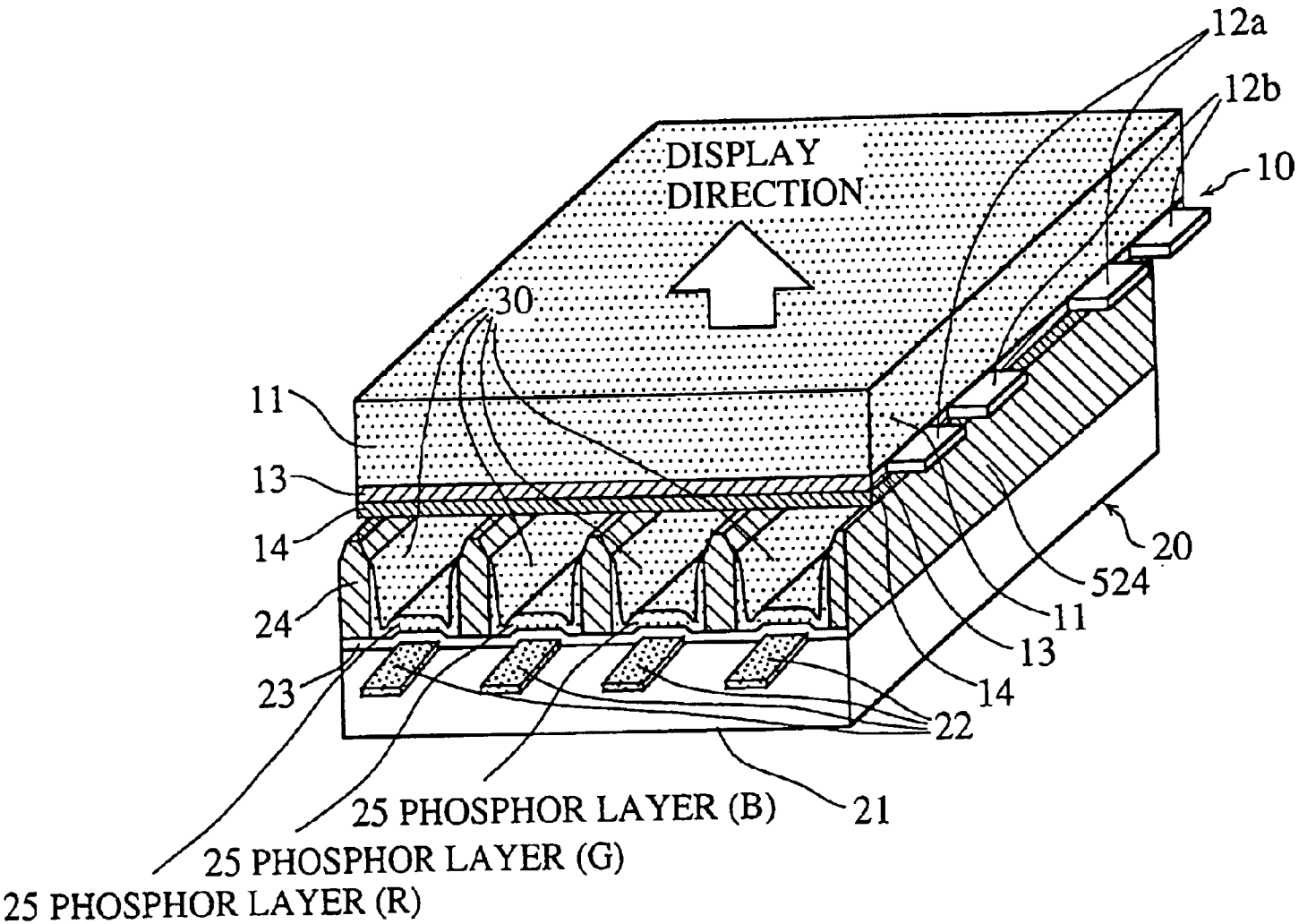
FIG. 1 is a sectional view of the main part of a surface-discharge type PDP in an embodiment.

FIG. 1 is a sectional view of the main part of a surface-discharge type PDP in the present embodiment. The figure shows a display area located at the center of the PDP.

The PDP includes: a front panel 10 which is made up of a front glass substrate 11 with display electrodes 12 (divided into scanning electrodes 12*a* and sustaining electrodes 12*b*), a dielectric layer 13, and a protecting layer 14 formed thereon; and a back panel 20 which is made up of a back glass substrate 21 with address electrodes 22 and a base dielectric layer 23 formed thereon. The front panel 10 and the back panel 20 are arranged so that the display electrodes 12 and the address electrodes 22 face each other. The space between the front panel 10 and the back panel 20 is divided into a plurality of discharge spaces 30 by barrier ribs 24 formed in stripes. Each discharge space is filled with a discharge gas.

Phosphor layers 25 are formed on the back panel 20 so that each discharge space 30 has a phosphor layer of one color out of red, green, and blue and that the phosphor layers are repeatedly arranged in the order of the colors.

In the panel, the display electrodes 12 and address electrodes 22 are respectively formed in stripes, the display electrodes 12 being perpendicular to the barrier ribs 24, and the address electrodes 22 being parallel to the barrier ribs 24. A cell having one color out of red, green, and blue is formed at each intersection of a display electrode 12 and an address electrode 22.

The address electrodes 22 are made of metal (e.g., silver or Cr—Cu—Cr). To keep the resistance of the display electrodes low and to secure a large discharge area in the cells, it is desirable that each display electrode 12 consists of a plurality of bus electrodes (made of silver or Cr—Cu—Cr) with a small width stacked on a transparent electrode with a large width made of a conductive metal oxide such as ITO, $SnO_2$, and ZnO. However, the display electrodes 12 may be made of silver like the address electrodes 22.

The dielectric layer 13, being a layer composed of a dielectric material, covers the entire surface of one side of the front glass substrate 11 including the display electrodes 12. The dielectric layer is typically made of a lead base low-melting-point glass, though it may be made of a bismuth base low-melting-point glass or a stack of a lead base low-melting-point glass and a bismuth base low-melting-point glass.

The protecting layer 14, being made of magnesium oxide (MgO), is a thin layer covering the entire surface of the dielectric layer 13.

The base dielectric layer 23 is similar to the dielectric layer 13, but is further mixed with $TiO_2$ grains so that the layer also functions as a visible-light reflecting layer.

The barrier ribs 24, being made of glass, are formed to project over the surface of the base dielectric layer 23 of the back panel 20.

The following are the phosphors used in the present embodiment:

| | |
|---|---|
| blue phosphor | $BaMgAl_{10}O_{17}$: Eu |
| green phosphor | $Zn_2SiO_4$: Mn |
| red phosphor | $(Y_xGd_{1-x})BO_3$: Eu. |

The composition of these phosphors is basically the same as that of conventional materials used in PDP.

In the present embodiment, on the assumption that the present PDP is used for a 40-inch high definition TV, the thickness of the dielectric layer 13 is set to approximately 20 μm, and the thickness of the protecting layer 14 to approximately 0.5 μm. Also, the height of the barrier ribs 24 is set to 0.1 mm to 0.15 mm, the pitch of the barrier ribs to 0.15 mm to 0.3 mm, and the thickness of the phosphor layers 25 to 5 μm to 50 μm. The discharge gas is Ne—Xe gas in which Xe constitutes 5% in volume. The charging pressure is set to $6\times10^4$ Pa to $10\times10^4$ Pa.

Figure 2:
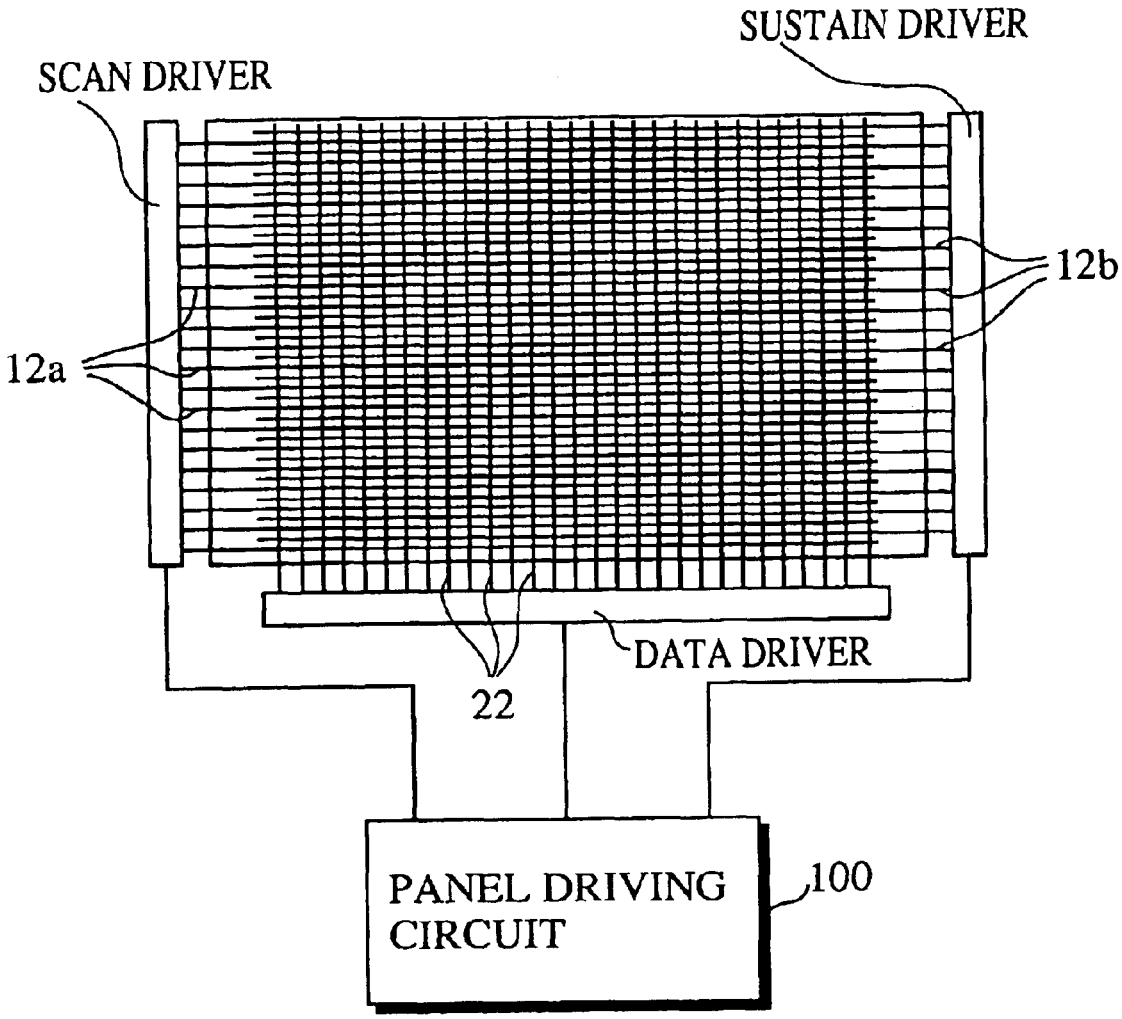
FIG. 2 shows the construction of an image display apparatus to which a driving apparatus is connected.

The PDP is driven by the following procedure. As shown in FIG. 2, a panel driving circuit 100 is connected to the PDP. An address discharge is produced by applying a certain voltage to an area between the display electrodes 12*a* and the address electrodes 22 of the cells to illuminate. A sustaining discharge is then produced by applying a pulse voltage to an area between the display electrodes 12*a* and 12*b*. The cells emit ultraviolet rays as the discharge proceeds. The emitted ultraviolet rays are converted to visible light by the phosphor layers 31. Images are displayed on the PDP as the cells illuminate through the above-described procedure.

Procedure of Producing PDP

The PDP with the above construction is produced as follows.

Producing the Front Panel

The front panel 10 is produced by forming the display electrodes 12 on the front glass substrate 11, covering them with the dielectric layer 13, then forming the protecting layer 14 on the surface of dielectric layer 13.

The display electrodes 12 are produced by applying silver pastes to the surface of the front glass substrate 11 by the screen printing method, then baking the applied silver pastes. The dielectric layer 13 is formed by applying a lead base glass material (e.g., a mixed material of 70% by weight of lead oxide (PbO), 15% by weight of boron oxide ($B_2O_3$), and 15% by weight of silicon oxide ($SiO_2$)), then baking the applied material. The protecting layer 14 consisting of magnesium oxide (MgO) is formed on the dielectric layer 13 by the vacuum vapor deposition method or the like.

Producing the Back Panel

The back panel 20 is produced by forming the address electrodes 22 on the back glass substrate 21, covering them with the base dielectric layer 23 (visible-light reflecting layer), then forming the barrier ribs 30 on the surface of the base dielectric layer 23.

The address electrodes 22 are produced by applying silver pastes to the surface of the back glass substrate 21 by the screen printing method, then baking the applied silver pastes. The base dielectric layer 23 is formed by applying pastes including $TiO_2$ grains and dielectric glass grains to the surface of the address electrodes 22 by the screen printing method, then baking the applied pastes. The barrier ribs 30 are formed by repeatedly applying pastes including glass grains at a certain pitch by the screen printing method, then baking the applied pastes.

After the back panel 20 is made, the phosphor pastes of red, green, and blue are made and applied to the space between the barrier ribs by the screen printing method. Pre-baking phosphor layers are completed by drying the applied phosphor pastes.

The phosphor pastes of each color are obtained by mixing phosphor grains of each color with an organic binder (e.g., ethyl cellulose of 50,000 moledular weight) and a solvent.

The pre-baking phosphor layers can be formed by-methods other than the screen printing. For example, the pre-baking phosphor layers may be formed by allowing a moving nozzle to eject phosphor ink, or by making a sheet of photosensitive resin including a phosphor for each color, attaching the sheet to the surface of the back glass substrate 21 on which the barrier ribs 24 are formed, performing a photolithography patterning then developing the attached sheet to remove unnecessary parts of the attached sheet.

Bonding Front Panel and Back Panel, Evacuating, and Enclosing Discharge Gas

Figure 3:
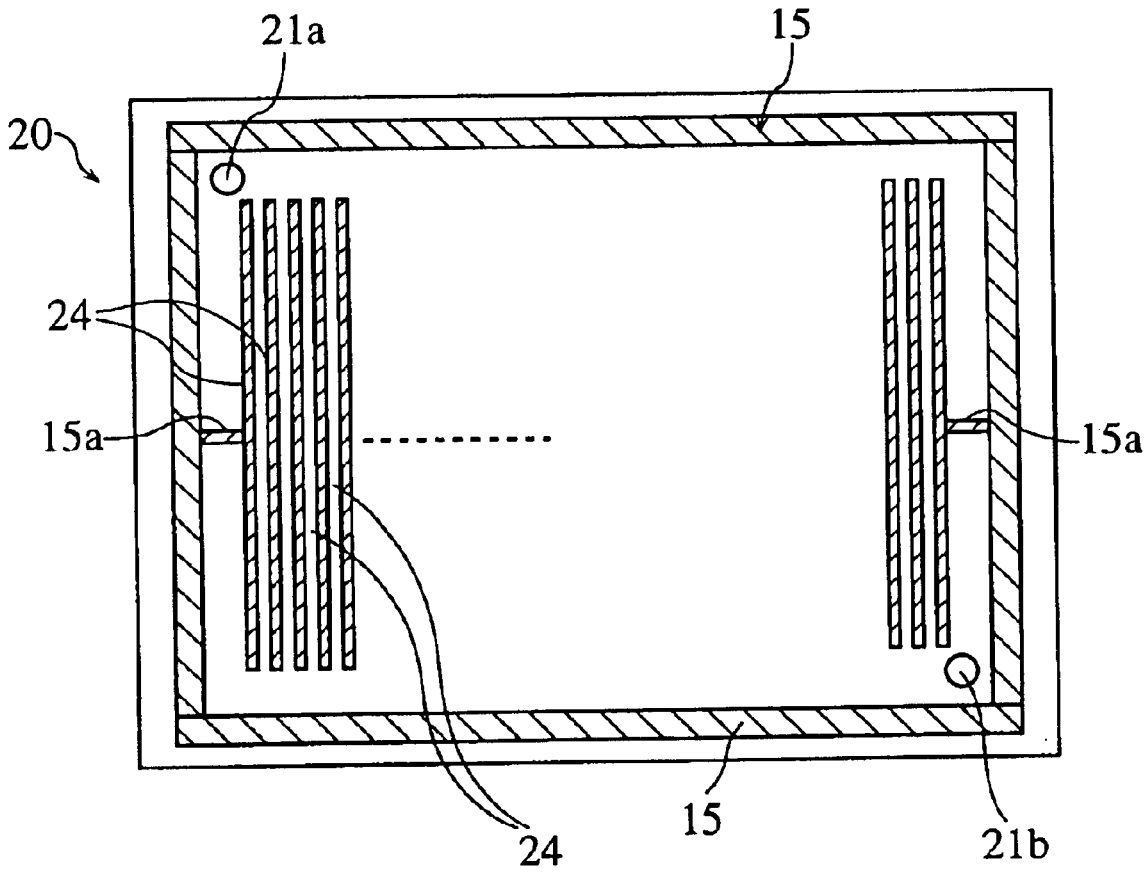
FIG. 3 shows the sealing glass layer formed at the outer region of the surface of the back panel.

A sealing glass layer is formed by applying a sealing glass paste (including a sealing glass frit and an organic binder) to the outer region of the surface of one of the front panel 10 and the back panel 20 (the surface facing the other panel) which have been produced as above. FIG. 3 shows the sealing glass layer 15 formed at the outer region of the surface of the back panel 20.

As described below, first a frit preliminary baking process, a phosphor baking process, and a bonding process are performed, then the bonded panels are baked while evacuating internal space between the panels. The discharge gas with the above composition is enclosed at a certain pressure. This completes the PDP.

In the present embodiment, the frit preliminary baking process, phosphor baking process, bonding process, and exhausting process are performed in succession.

Figure 4:
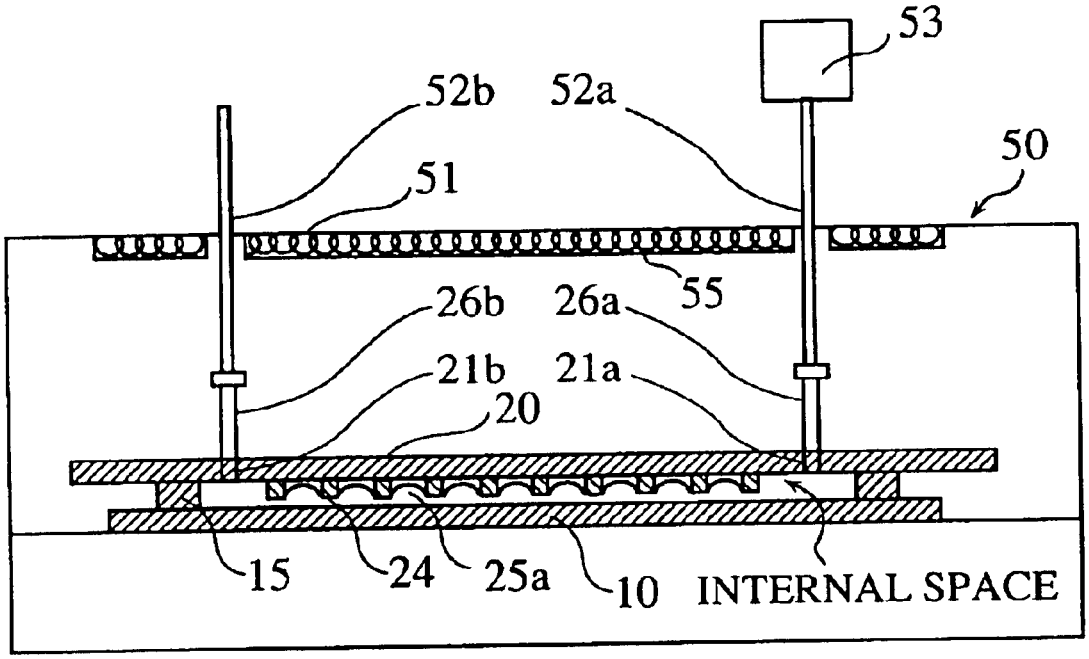
FIG. 4 shows the construction of a heating/baking apparatus used in Embodiment 1.

FIG. 4 shows the construction of a heating/baking apparatus used in the above processes.

The heating/baking apparatus 50 includes a heating furnace 51 for heating the substrates (in the present embodiment, the front panel 10 and the back panel 20 facing each other) using a heater 55, a pipe 52*a* for guiding an atmospheric gas from outside of the heating furnace 51 into internal space between the front panel 10 and the back panel 20, and a pipe 52*b* for exhausting the atmospheric gas to the outside the heating furnace 51 from the internal space. The pipe 52*a* is connected to a dry air supply source 53 which supplies dry air.

Note that a gas dryer (not illustrated) is included in the dry air supply source 53. The gas dryer removes water contained in air by cooling the air to a low temperature (minus several tens ° C.) to freeze the water. The amount of water vapor in air (water vapor partial pressure) is reduced after the air passes through the gas dryer.

The bonding process is performed as described below using the heating/baking apparatus 50.

As shown in FIG. 3, air vents 21*a* and 21*b* are formed outside the display area at diagonal corner positions in the outer region on the surface of the back panel 20. Also, as shown in FIG. 4, glass pipes 26*a* and 26*b* are attached to the air vents 21*a* and 21*b*, respectively. Note that the sign 25*a* in FIG. 4 represents the pre-baking phosphor layers.

Figure 5:
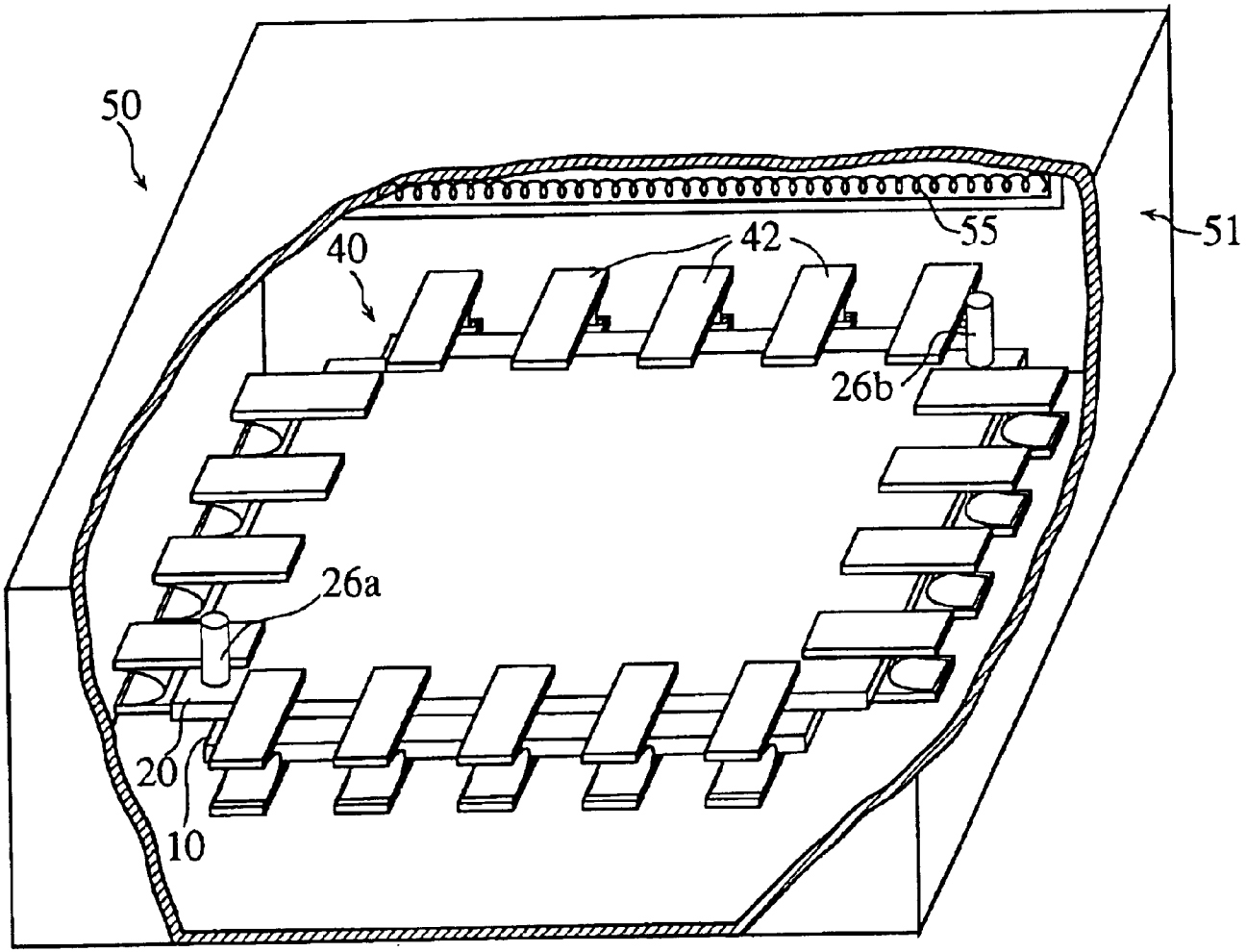
FIG. 5 shows how the panels are tightened in Embodiment 1.

The front panel 10 and the back panel 20 are positioned properly with the sealing glass layer 15 in between, then put into the heating furnace 51. In doing so, it is preferable that the outer region of the positioned front panel 10 and the back panel 20 is tightened with clamps (clips) 42, as shown in FIG. 5, so that the panels do not shift.

It is not desirable that the pressing points of the clamps 42 are outside the sealing glass layer 15. This is because by the pressure of the clamps 42, the rims of the panels 10 and 20 deform to be close to each other. This causes the central portions of the panels 10 and 20 to move away from each other by leverage action with the outer ends of the barrier ribs 24 becoming the fulcrum of the leverage action. This creates gap between the front panel 10 and the top of the barrier ribs 24, the gap remaining even after the panels 10 and 20 are bonded together.

On the other hand, it is desirable that the pressing points of the clamps 42 are inside the sealing glass layer 15 since the above deformation is prevented. Furthermore, when the clamps 42 are set to press inside the outer ends of the barrier ribs 24, the central portions of the panels 10 and 20 come close to each other by the pressure of the clamps 42. This reduces the gap between the front panel 10 and the top of the barrier ribs 24 even after the panels 10 and 20 are bonded together.

Pipes 52*a* and 52*b* inserted from outside the heating furnace 51 are connected to the glass pipes 26*a* and 26*b*, respectively. The dry air supply source 53 supplies a constant amount of dry air to the internal space between the panels 10 and 20 through the pipe 52*a*, glass pipe 26*a*, and air vent 21*a*. This enables the dry air to circulate inside the internal space and be exhausted through the air vent 21*b*, glass pipe 21*b*, and pipe 52*b*.

The panels 10 and 20 are heated while the dry air is supplied to the internal space as described above. During this process, the phosphor layers are baked, the sealing glass layer is preliminarily baked, and the panels 10 and 20 are bonded together.

The temperature changes in the heating furnace during the above process. This temperature change will be described in detail later with reference to an example, but basically, the temperature in the furnace is once increased to a peak temperature T3 that is higher than the softening point of the sealing glass frit used for the sealing glass layer 15 (see FIG. 9), then decreased to be lower than the softening point. The pre-baking phosphor layer 25*a* is baked at the peak temperature T3. Typically, the peak temperature T3 (e.g., 520° C.) is maintained for a certain time period (e.g., 20 minutes) to secure the baking of the phosphor layers and softening of the sealing glass layer.

During the above process, the organic binders included in the sealing glass layer 15 and pre-baking phosphor layers 25*a* are burned out, and the sealing glass layer 15 is softened to bond the panels 10 and 20 together.

The temperature in the furnace is then decreased and the supply of the dry air is stopped. During this, the sealing glass layer 15 hardens when the temperature falls as low as the softening point of the sealing glass, completing the bonding of the panels 10 and 20.

For the performing the above process, the material for the sealing glass frit must have the softening point lower than the phosphor layer baking temperature. Since an appropriate temperature for baking the phosphor layers is considered to be approximately 520° C., a material with the softening point lower than 520° C. must be selected for the sealing glass frit, to bake the phosphor layers and bond the panels in one process.

On the other hand, when the softening point of the sealing glass frit is too low, the sealing glass layer may deform while the phosphor layers are baked. As a result, it is desirable that the softening point of the sealing glass frit is higher than 400° C.

Following the bonding process, the temperature in the heating furnace 51 is decreased to cool the panels 10 and 20 inside it. During this, when the temperature of the panels 10 and 20 decreases to a predetermined temperature, the exhausting process is performed.

In this exhausting process, at some midpoint (i.e., when the panels 10 and 20 reach a predetermined temperature) while the panels 10 and 20 are cooled to ambient temperature, impurity gases adsorbed on the substrates are removed by evacuating the internal space, maintaining the panels 10 and 20 at the predetermined temperature for a predetermined time period (e.g., 350° C. for 3 hours). Note that it is possible to perform the exhausting process while one of the glass pipes 26*a* and 26*b* is plugged, and the other connected to a vacuum pump.

After the panels return to ambient temperature in the exhausting process, the discharge gas enclosing process is performed. Note that it is possible to perform the discharge gas enclosing process by connecting the glass pipe 26*a* or 26*b*, which is connected to the vacuum pump, further to a discharge-gas cylinder, and allowing the cylinder to enclose the discharge gas into the internal space.

Effects of the Method Shown in the Present Embodiment

As described above, in the present embodiment, the frit preliminary baking process, phosphor baking process, and bonding process are performed in one process in a furnace. This, compared to conventional methods in which the frit preliminary baking process, phosphor baking process, and bonding process are performed separately, reduces the time and energy required for the production. Also, since the number of times the phosphors are exposed to heat is reduced in this method, degradation of the phosphors (in light-emitting intensity and chromaticity) is suppressed.

Water is adsorbed on the substrates, but it is released as the panels are heated. Suppose that the phosphors are baked and the sealing material is preliminarily baked while the panels are positioned to face each other, without supplying the dry air. Then, deterioration of the phosphors by heat and quality change of MgO tend to happen since the pre-baking phosphor layers 25*a* and protecting layer 14 in the internal space are exposed to high-temperature, high-density gases released from the panels (especially, water vapor released from the protecting layer 14). This results in decrease in discharge characteristics or luminous efficiency of the phosphors. Especially, chromaticity of the blue phosphors tends to be deteriorated by the heat.

Since the internal space between the panels is divided into such narrow spaces by the barrier ribs 24, it often happens that oxygen required for the burnout becomes short. When this happens, remains of burned organic substances may be left, or MgO or the phosphors that lack oxygen may be generated (hereinafter referred to as oxygen lack).

According to the present embodiment in which the panels are burned while dry air is supplied to the internal space, however, sufficient oxygen for burning out the resin in the pre-baking phosphor layers 25*a* is always supplied. This prevents the pre-baking phosphor layers 25*a* and protecting layer 14 from being exposed to high-temperature, high-density gases released from the panels or burning gases, preventing the phosphors from being deteriorated by heat and protecting the quality of the protecting layer 14.

In the method of the present embodiment, the exhausting process is performed in the same furnace at some midpoint before temperature of the panels is cooled to ambient temperature after the bonding process is completed. Compared to conventional methods in which the bonding process and the evacuation process are performed separately, the present method provides an effect of reducing the time and energy required for the production.

Partial Pressure of Water Vapor in Dry Air and Deterioration of Blue Phosphors by Heat It is desirable that the water vapor partial pressure in an atmosphere of the dry gas is set to as low a value as possible. For example, the water vapor partial pressure may be set to 10 Torr (1300 Pa) or less, 5 Torr (650 Pa) or less, or 1 Torr (130 Pa) or less. In other words, it is desirable that the dew-point temperature of the dry gas is set to as low a value as possible. For example, the dew-point temperature may be set to 12° C. or lower, 0° C. or lower, or −20° C. or lower. It is more desirable that the dew-point temperature is set to −50° C. or lower.

It is also confirmed by the following experiment results that the deterioration of the blue phosphor due to heating can be prevented by reducing the partial pressure of water vapor in the atmospheric gas.

Figure 6:
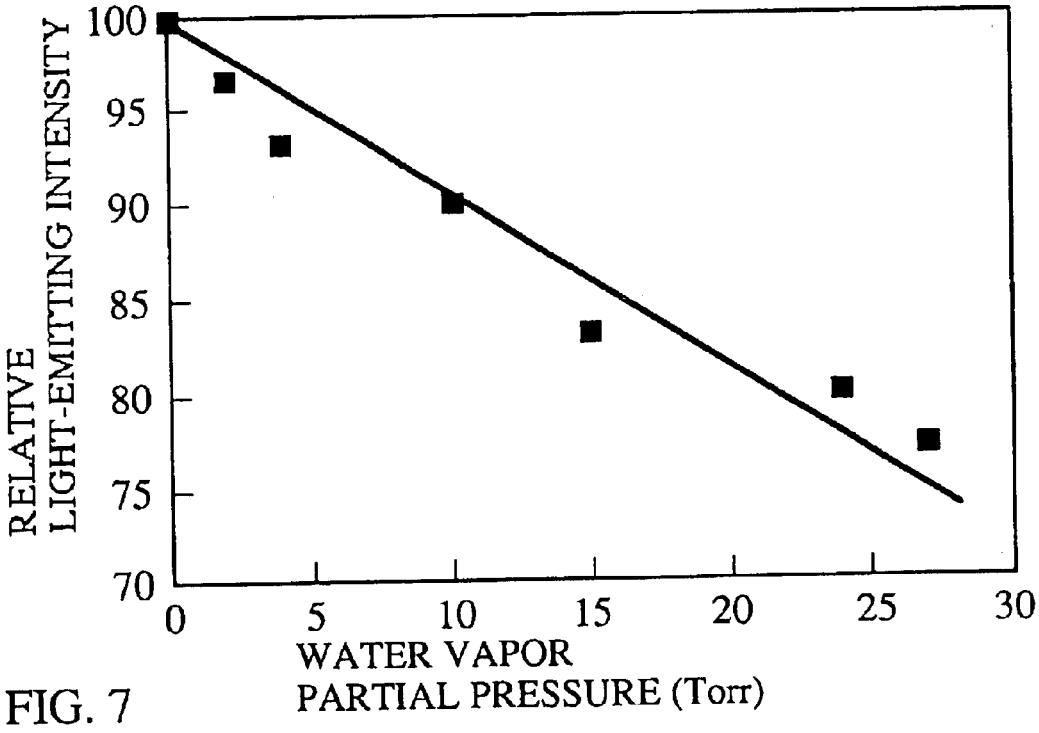
FIGS. 6 and 7 respectively show the relative light-emitting intensity and the chromaticity coordinate y of the light emitted from the blue phosphor after the blue phosphor was baked in air by changing the water vapor partial pressure variously.
Figure 7:
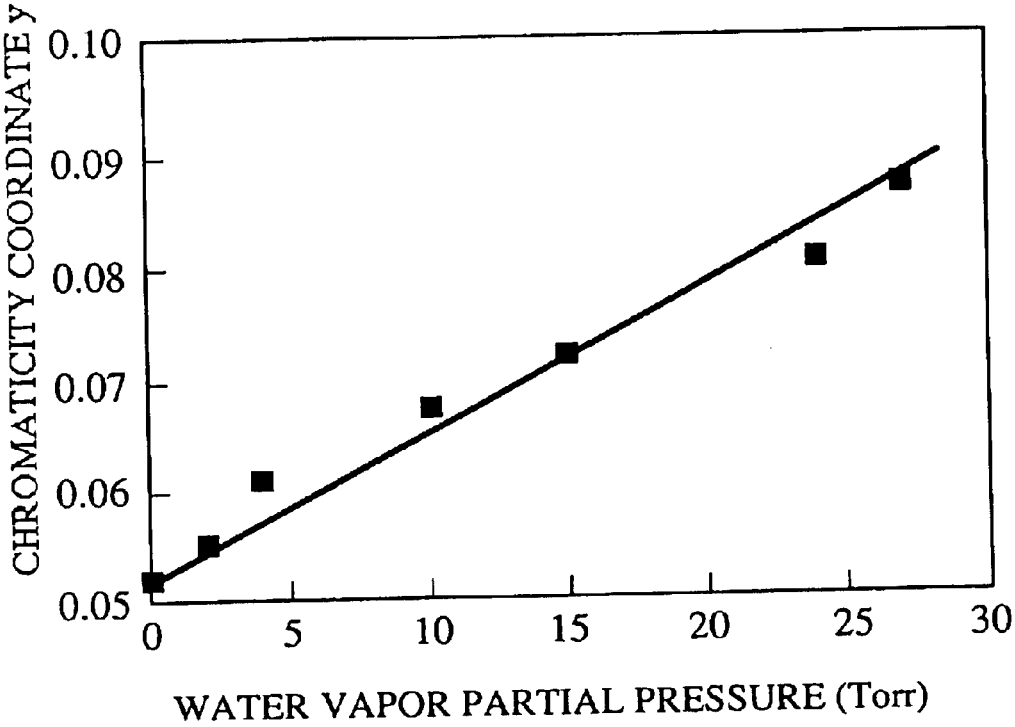

FIGS. 6 and 7 respectively show the relative light-emitting intensity and the chromaticity coordinate y of the light emitted from the blue phosphor ($BaMgAl_{10}O_{17}$: Eu). These values were measured after the blue phosphor was baked in the air by changing the water vapor partial pressure variously. The blue phosphor was baked at the peak temperature 450° C. for 20 minutes.

The relative light-emitting intensity values shown in FIG. 6 are relative values when the light-emitting intensity of the blue phosphor measured before it is baked is set to 100 as the standard value.

For obtaining the light-emitting intensity, first the emission spectrum of the phosphor layer is measured using a spectro-photometer, next the chromaticity coordinate y is calculated from the measured emission spectrum, then the light-emitting intensity is obtained from a formula (light-emitting intensity=luminance/chromaticity coordinate y) with the calculated chromaticity coordinate y and a luminance measured beforehand.

Note that the chromaticity coordinate y of the blue phosphor before it was baked was 0.052.

It is found from the results shown in FIGS. 6 and 7 that there is no reduction of light-emitting intensity by heat and that there is no change in the chromaticity when the water vapor partial pressure is approximately 0 Pa. However, it is noted that as the water vapor partial pressure increases, the relative light-emitting intensity of the blue phosphor decreases and the chromaticity coordinate y of the blue phosphor increases.

It has conventionally been thought that the light-emitting intensity reduces and the chromaticity coordinate y increases when the blue phosphor ($BaMgAl_{10}O_{17}$: Eu) is heated because activating agent $Eu^{2+}$ ion is oxidized and converted into $Eu3^{+}$ ion through the heating (S. Oshio, T. Matsuoka, S. Tanaka, and H. Kobayashi, Mechanism of Luminance Decrease in $BaMgAl_{10}O_{17}$:$Eu^{2+}$ Phosphor by Oxidation, J. Electrochem. Soc., Vol.145, No.11, November 1998, pp.3903–3907). However, considering the fact that the chromaticity coordinate y of the above blue phosphor depends on the partial pressure of water vapor in the atmosphere, it is thought that $Eu^{2+}$ ions do not directly react with oxygen in the atmospheric gas (e.g., air), but that water vapor in the atmospheric gas accelerates the reaction related to the deterioration.

Consideration of Dry Air Circulation

Regarding the Shape of the Sealing Glass Layer 15

Basically, to obtain the effect of preventing the phosphors from deteriorating due to heat, the dry air circulating in the internal space needs to flow over the phosphors. When more dry air flow outside the outer ends of the barrier ribs 24 than inside, a small amount of dry air flows over the phosphors (through the spaces between the barrier ribs). This decreases the the effect of preventing the phosphors from deteriorating due to heat.

In contrast, when partitions 15*a* are formed at approximately the center of gaps between the sealing glass layer 15 and the outer ends of the barrier ribs 24, as shown in FIG. 3, most of the dry air circulating in the internal space flows through the spaces between the barrier ribs. It is therefore desirable for obtaining the effect of preventing the phosphors from deteriorating due to heat that such partitions are formed at such positions.

Flow Rate of Dry Air

A desirable flow rate of dry air circulating in the internal space is 1 CCM per unit volume of the internal space (1 $cm^3$).

Also, a desirable flow rate of oxygen is 0.5 CCM or higher per unit volume of the internal space (1 $cm^3$). This flow rate of oxygen is obtained as follows.

When a typical 42-inch PDP is manufactured, phosphor ink containing approximately 10 g of resin is applied to one panel, and the total volume of the discharge space is approximately 50 $cm^3$. A flow rate of oxygen required for manufacturing this size of PDP is considered, where it is presumed that ethyl cellulose $(C_{12}H_{22}O_5)_n$ is used as an organic binder of the phosphor ink.

The reaction of the ethyl cellulose when it completely burns is represented as follows.

$$(C_{12}H_{22}O_5)_n+15nO_2\rightarrow 12nCO_2+11nH_2O$$

From the above expression, the number of moles of the oxygen molecules necessary to completely burn 10 g of ethyl cellulose is obtained as 10÷246×15=0.61 (mol). This amount of oxygen is converted to a volume as 0.61×22.4=13664 cc.

Suppose 5 hours is used for the burnout, then the flow rate of oxygen required to completely burn 10 g of ethyl cellulose in 5 hours is 13664÷(5×60)=45.5 CCM. This flow rate per unit volume of the discharge space is represented as 45.5÷50=0.91 CCM (approximately 1 CCM).

It is found from above that to set the burnout time to 10 hours or less, the flow rate of oxygen circulating in the internal space should be set to 0.5 CCM or higher per unit volume of the internal space.

Thickness of Glass Substrate

When dry air is supplied so as to circulate in the internal space of the facing panels while the outer region of the panels is tightened with clamps as described above, the internal space has the positive pressure (higher than outside). Here, though the outer region is tightened, the central portions of the panels are not tightened. Also, the glass substrate has elasticity. As a result, the central portions of the panels deform to move away from each other (i.e., the central portions swell). The swell is eliminated as the supply of the dry air is stopped when the temperature in the furnace is decreased.

Here, it is desirable that the glass substrate is thin. This is because the thinner the glass substrate, the larger the swell is, and the greater the distance between the panels at the center is. This enables the dry air supplied to the internal space to flow over the phosphor layers smoothly.

It is accordingly desirable that either of the front glass substrate 11 or the back glass substrate 21 is thin so that the dry gas circulates in the internal space smoothly.

In a lot of current PDPs, the front and back glass substrates are both 2.8 mm thick. To obtain the above effect, however, it is desirable that one of or both the front and back glass substrates have thickness of 2.0 mm or less. Note that in any cases, the substrates need to have the minimum thickness required for functioning as substrates. The effect obtained by the above-described construction is confirmed by the following experiment results.

Some glass substrates having different thicknesses were prepared. Each of the glass substrates was coupled with a glass substrate with a constant thickness. The outer region of each of the pairs was tightened, and air was circulated in the internal space between the panels, while the amount of swell (distance between the panels) at the center was measured.

Figure 8:
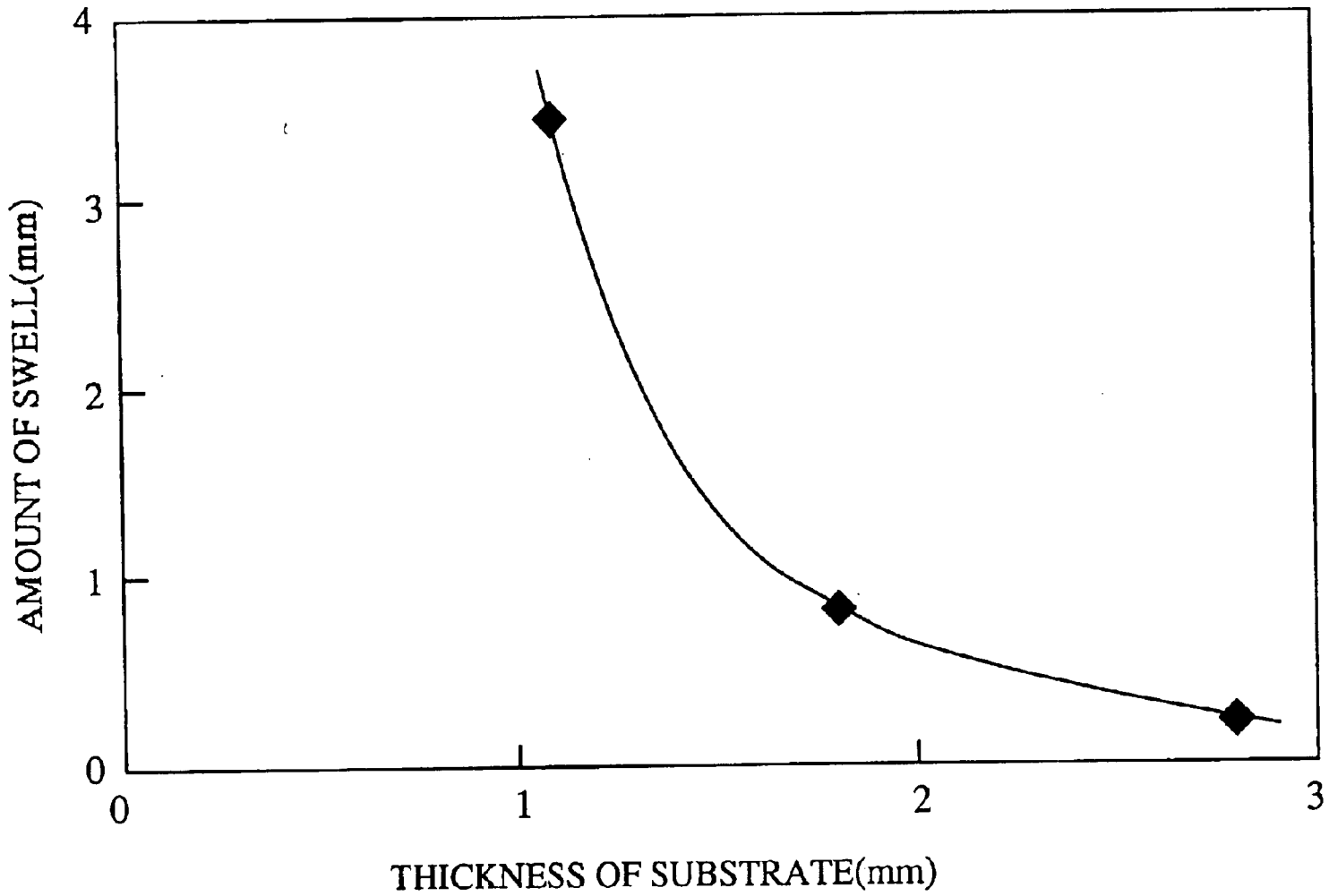
FIG. 8 is a plot showing relationships between the thickness of glass substrate and the amounts of swell in the case where air is circulated in space between the glass substrates.

FIG. 8 is a plot showing relationships between the thickness of glass substrate (mm) and the amounts of swell (mm) that were obtained through the experiment.

It is understood from FIG. 8 that the amount of swell is large when the thickness of the glass substrate is 2 mm or less.

It is also possible to use a metal substrate instead of the back glass substrate 21, for example. However, glass substrates have lower elastic constants than metal substrates. Therefore, using glass substrates is advantageous than metal substrates since with glass substrates, the amount of swell is larger and the dry gas circulates in the internal space more smoothly.

Glass is, however, fragile and vulnerable to deformation. That is to say, thin glass substrates are weak. In contrast, metal substrates have excellent ductility, and thin metal substrates still maintain the strength. Also, metal substrates have excellent productivity. As a result, metal substrates are advantageous in terms of these characteristics. It is considered that Al, among all known metals, is desirable as a material for the substrate since Al has a relatively low elastic constant.

Variations of Embodiment 1

(1) In the above embodiment, dry air is circulated in the internal space. However, a dry gas containing oxygen (an inert gas such as nitrogen) may be supplied to obtain the same effect.

(2) In the production method described in the above embodiment, a constant amount of dry air is supplied to the internal space. However, the flow rate of the supplied air may be changed as necessary. Also, evacuation of the internal space and supply of dry air may be alternated. This enables oxygen to be supplied to the internal space and enables water vapor or the like that are generated in the internal space to be exhausted from there. This method also provides the above effect to some extent.

(3) In the production method described in the above embodiment, a typical glass frit is used as the sealing material. However, a crystalline glass may be used instead. A typical crystalline glass is a PbO—ZnO—$B_2O_3$ base frit glass.

In the case where a normal frit glass is used as the sealing glass layer, the sealing glass layer may be deformed when dry air is circulated in the internal space at a temperature higher than the softening point of the normal frit glass. In contrast, crystalline glasses become fluid, crystallize, and harden when they are heated. Once they harden, the crystalline glasses do not soften even when heated to a temperature higher than the crystalline temperature. As a result, in the case where a crystalline glass is used as the sealing glass layer, the sealing glass layer does not deform even if the internal space is further heated after it crystallizes while dry air is circulated in the internal space.

(4) In the production method described in the above embodiment, the frit preliminary baking process, phosphor baking process, and bonding process are performed in one process in a furnace while dry gas is circulated in the internal space of the panels disposed to face each other. However, the back panel 20, on which the sealing glass layer is formed, may be preliminarily baked first, then the back panel 20 may be disposed to face the front panel 10, then the phosphor baking process and the panel bonding process may be performed in one process while dry air is supplied to the internal space between the panels.

When compared to the production method of the present embodiment, this method is inferior in terms of the time and energy required for the production since the preliminary baking process is separately performed. However, compared to conventional production methods, this method is superior in terms of the time and energy required for the production since the phosphor baking process and the panel bonding process are performed in one process.

In the case of the present embodiment, when two panels are disposed to face each other, the sealing glass layer tends to collapse. In contrast, in the case of this variation, the sealing glass layer would not collapse in the bonding process since it has been preliminarily baked and the binding force between the glass frits has been strengthened. This characteristic contributes to enhancement of yield.

EXAMPLES

TABLE 1

Figure 9:
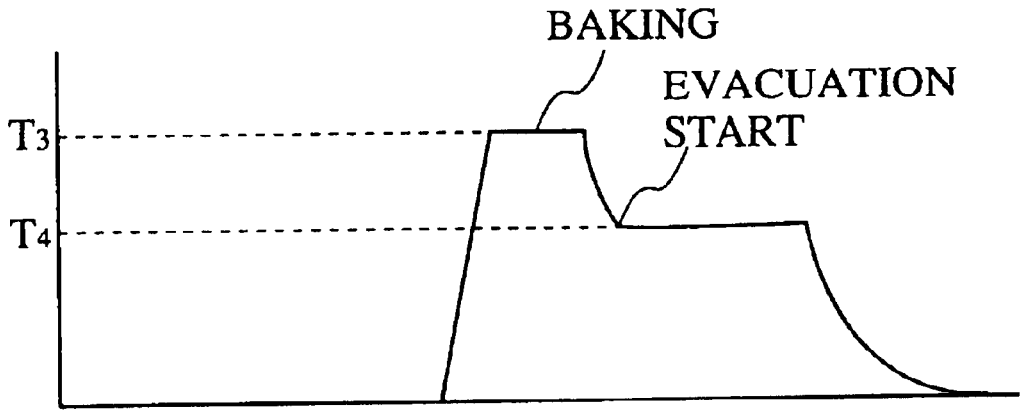
FIGS. 9–12 show temperature profiles related to a production method in an embodiment.
Figure 10:
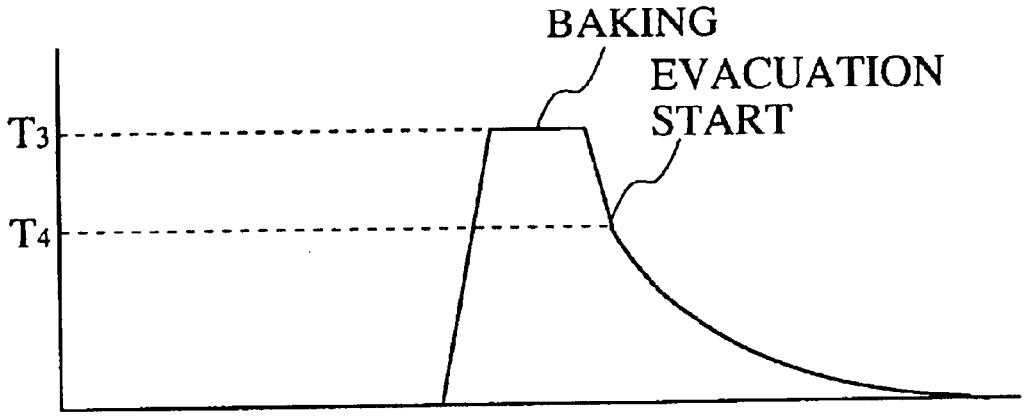
Figure 11:
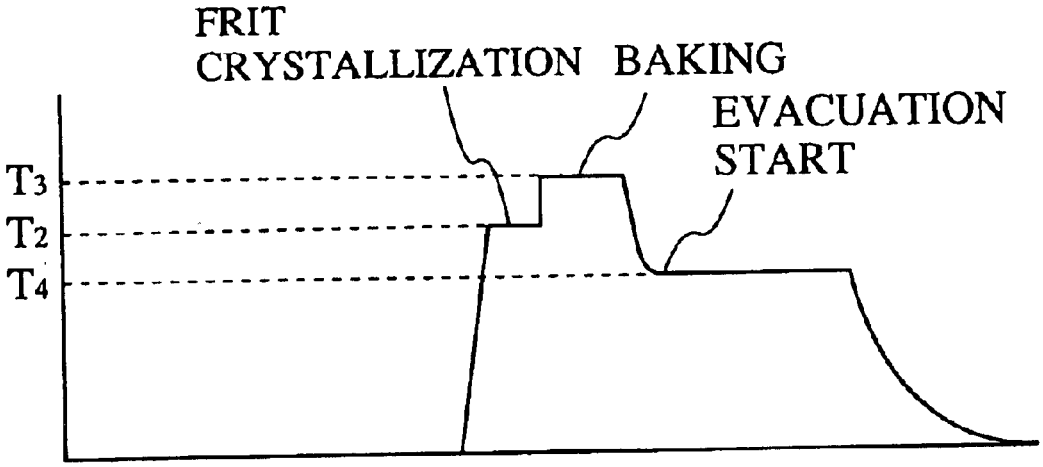
Figure 12:
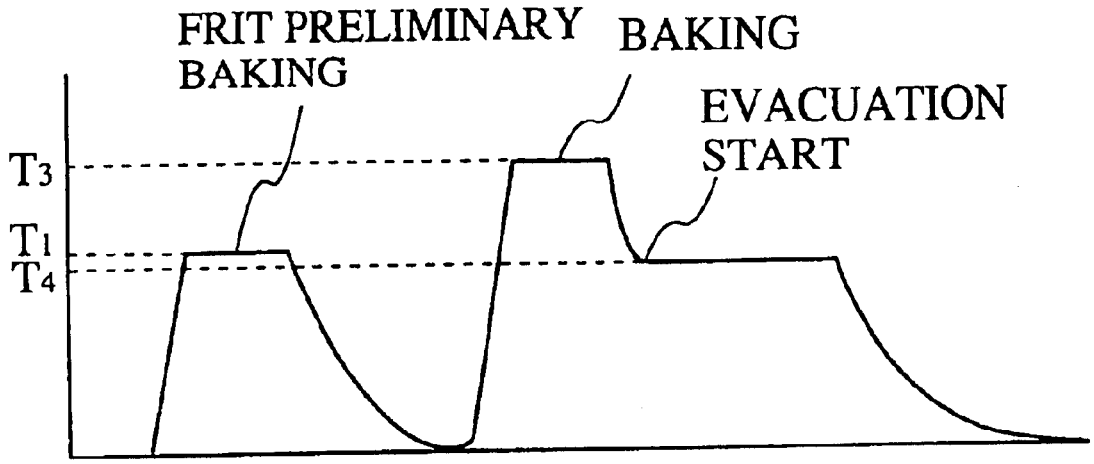

| EXAMPLE | | TEMPERATURE(°C.) | | | | FRIT | | | |
|---|---|---|---|---|---|---|---|---|---|
| | | | | | | | SOFTENING POINT | CRYSTALLIZATION TEMP. | REQUIRED TIME |
| No. | PROFILE | T1 | T2 | T3 | T4 | TYPE | (°C.) | (°C.) | (h) |
| 1 | FIG. 8 | — | — | 520 | 350 | NORMAL | 450 | — | 6 |
| 2 | FIG. 8 | — | — | 520 | 350 | NORMAL | 400 | — | 6 |
| 3 | FIG. 8 | — | — | 520 | 350 | NORMAL | 380 | — | 6 |
| 4 | FIG. 8 | — | — | 520 | 450 | NORMAL | 450 | — | 6 |
| 5 | FIG. 8 | — | — | 520 | 200 | NORMAL | 450 | — | 6.5 |
| 6 | FIG. 9 | — | — | 520 | 350 | NORMAL | 450 | — | 7.5 |
| 7 | FIG. 10 | — | 450 | 520 | 350 | CRYSTALLINE GLASS | 380 | 450 | 6.5 |
| 8 | FIG. 11 | 380 | — | 520 | 350 | NORMAL | 450 | — | 9.5 |
| 9 | FIG. 12 | 520 | 350 | 520 | 350 | NORMAL | 380 | — | 15 |

Examples No. 1–8 shown in Table 1 are PDPs manufactured by the method shown in Embodiment 1. In manufacturing these example PDPs, the frit preliminary baking process, phosphor baking process, and panel bonding/exhausting process are performed based on the temperature profiles shown in FIGS. 9–12, as shown in Table 1.

The example No. 9 is a PDP manufactured by a comparative method. In manufacturing this example PDP, the frit preliminary baking process, phosphor baking process, bonding process, and panel bonding/exhausting process are performed based on the temperature profile shown in FIG. 13.

The signs T1–T4 appearing in Table 1 and FIGS. 9–13 represent the following temperatures.

T1: frit preliminary baking temperature

T2: frit crystalline temperature

T3: phosphor baking and panel bonding temperature (peak temperature)

T4: exhausting temperature

It should be noted here that when each of Example PDPs No. 1–9 is manufactured, partitions 15*a* are formed when the sealing glass layer 15 is formed. Therefore, they have the same panel construction.

Example PDPs No. 1–5 were manufactured using a normal frit, based on the temperature profile shown in FIG. 9. However, the frit softening point and the exhausting temperature are set to various values.

More particularly, Example PDPs No. 1–5 were manufactured as the temperature profile shown in FIG. 9 indicates, by heating the panels to the peak temperature T3, then maintaining the panels at the peak temperature T3 for 30 minutes so that the phosphors are baked and the sealing material is softened. Then the panels were laid to cool off by themselves to the exhausting temperature T4 so that the panels are completely bonded together. Gases were exhausted from the space between the panels while the panels were maintained at the exhausting temperature T4 for a certain time period. In this exhausting process, the temperature at the time when the degree of vacuum reached $1.3\times10^{-5}$ Pa was maintained for 2 hours. After the exhausting process, the panels were laid to cool off by themselves.

The total manufacturing time (from the instant when the temperature starts being raised to the instant when the gas exhaust is completed) for each of Examples 1–5 was approximately 6 hours. Also, almost the same amount of electricity was used for manufacturing these examples.

It is noticed that it took a longer time to manufacture Example No. 5 than Examples No. 1–4. The reason for this is considered to be that the gases adsorbed on the panels were difficult to remove since the exhausting temperature T4 was set to a low temperature.

It was observed in Example No. 3, in which a frit glass having a low softening point was used, that the partitions 15*a* completely collapsed and the sealing glass layer 15 expanded abnormally in width after the panels were bonded together. In contrast, it was observed in Examples No. 1 and 4, in which frit glasses having relatively high softening points were used, that the sealing glass layer 15 kept its shape through the bonding process.

It is understood from above that a proper softening point of the frit glass is approximately 450° C. when the peak temperature T3 is 520° C. Example PDPs No. 1, 4, and 5 were evaluated in terms of lighting. According to the evaluation results, Example PDP No. 4, in which the exhausting temperature T4 is set to a high value, has a low luminance. The reason for this is considered to be that the oxygen lack was caused in the phosphors since the phosphors were laid at a high temperature and in vacuum for a long time during the exhausting process.

Example PDP No. 6 was manufactured using a normal frit glass, based on the temperature profile shown in FIG. 10. More particularly, Example PDP No. 6 was manufactured following the same procedure as the temperature profile shown in FIG. 9 until the gas exhaust is started at the exhausting temperature T4, but the temperature in the furnace was not controlled during the exhausting process and the panels were kept to cool off by themselves.

The total manufacturing time of Example PDP No. 6 is as long as 7.5 hours. The reason for this is considered to be that the gases adsorbed on the panels were difficult to remove since the temperature fell during the exhausting process.

Example PDP No. 7 was manufactured using a crystalline glass frit, based on the temperature profile shown in FIG. 11. More particularly, Example PDP No. 7 was manufactured following the same procedure as Example PDP No. 1 (the temperature profile shown in FIG. 9) except that the glass frit was crystallized by maintaining the frit crystalline temperature T2 for 30 minutes at some midpoint when the temperature is risen to the peak temperature T3, where the frit crystalline temperature T2 is higher than the softening point (380° C.).

The total manufacturing time of Example PDP No. 7 is 6.5 hours, a slightly longer time. The total consumed electricity is approximately the same as Example No. 1.

Example PDP No. 8 was manufactured using a normal frit glass, based on the temperature profile shown in FIG. 12. In manufacturing this, the back panel 20 on which the sealing glass layer was formed was preliminarily baked at the frit preliminary baking temperature T1, and the panels were cooled. After this, the back panel 20 was disposed to face the front panel 10, the panels were heated to the peak temperature T3 to bake the phosphors and bond the panels while dry air was circulated in the internal space, and gases were exhausted from the internal space at the exhausting temperature T4.

The total manufacturing time of Example PDP No. 8 is as long as 9.5 hours. However, this method of manufacturing Example PDP No. 8 is excellent because it contributes to the enhancement of yield since the sealing glass layer is difficult to collapse when the two panels are disposed to face each other.

Figure 13:
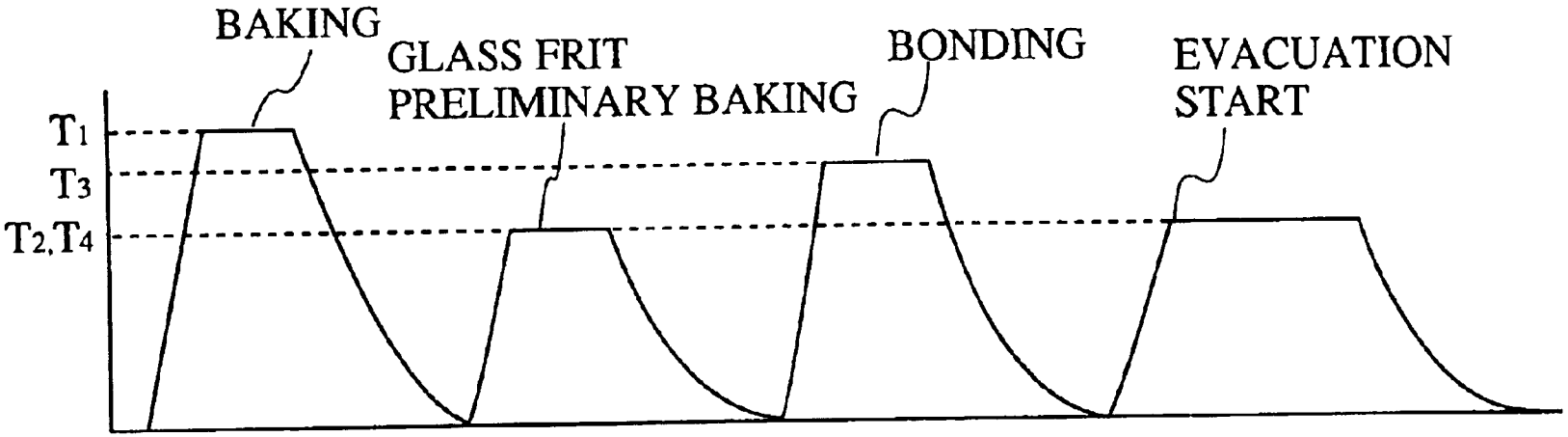
FIG. 13 shows a temperature profile related to a production method of a comparative example.

Comparative Example PDP No. 9 was manufactured using a normal frit glass, based on the temperature profile shown in FIG. 13. In manufacturing this, the temperature was raised and lowered for each of the phosphor baking process, frit preliminary baking process, bonding process, and exhausting process.

Compared to this comparative Example PDP No. 9, Example PDPs No. 1–8 are manufactured in less time with less electricity.

<Embodiment 2>

The PDP production method of Embodiment 2 is the same as Embodiment 1 except that the phosphor layer baking process and the bonding process are performed in the same furnace in one temperature raising operation.

It should be noted here however that in Embodiment 1, the phosphor layer baking process and the bonding process are performed while a dry gas is circulated in the internal space with the front and back panels 10 and 20 disposed to face each other, while in Embodiment 2, organic binders contained in the phosphor layers are burned out by heating the panels 10 and 20 that are separately disposed in a furnace, then disposing the panels 10 and 20 to face each other, and keeping the panels 10 and 20 being at a temperature higher than the softening point of the sealing material.

In Embodiment 2, after the front and back panels 10 and 20 are produced in the same way as Embodiment 1, the preliminary baking, phosphor layer baking, bonding, and exhausting processes are performed as described below. Note that in Embodiment 2, only air vent 21*a* is formed in the outer region on the surface of the back panel 20.

Figure 14:
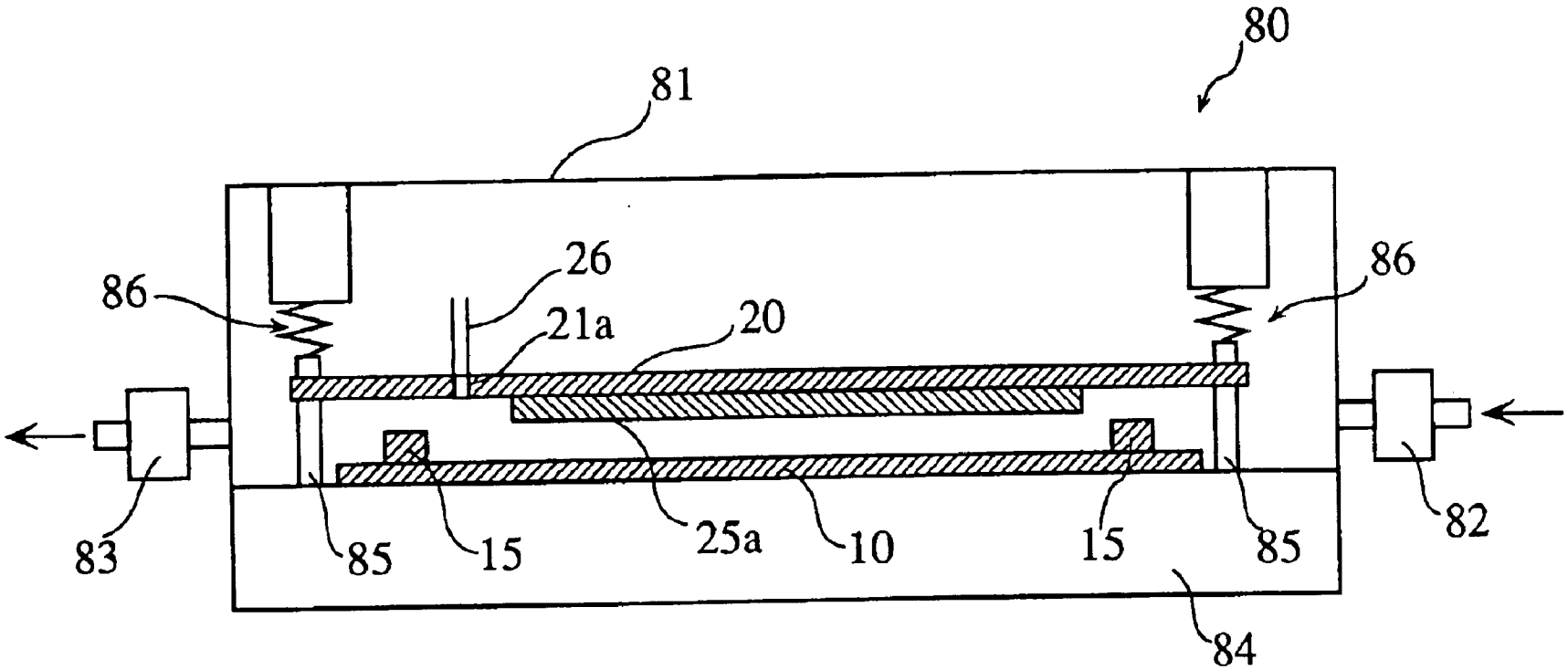
FIG. 14 shows the construction of a heating/baking apparatus used in Embodiment 2.

FIG. 14 shows the construction of a heating/baking apparatus used in Embodiment 2.

The heating/baking apparatus 80 includes a heating furnace 81 for heating the front panel 10 and the back panel 20, a gas supply valve 82 for adjusting the amount of atmospheric gas supplied into the heating furnace 81, and a gas exhaust valve 83 for adjusting the amount of gas exhausted from the heating furnace 81.

The inside of the heating furnace 81 can be heated to a high temperature by a heater (not illustrated). It is possible to circulate a dry air in the heating furnace 81 by supplying the dry air into the heating furnace through the gas supply valve 82 and exhausting the gas from the gas exhaust valve 83.

A base 84 is formed in the heating furnace 81. On the base 84, the front panel 10 and the back panel 20 are laid. Slide pins 85 for moving the back panel 20 parallel to the pins themselves are formed on the base 84. Above the base 84, pressing mechanisms 86 for pressing the back panel 20 downwards are formed.

Figure 15:
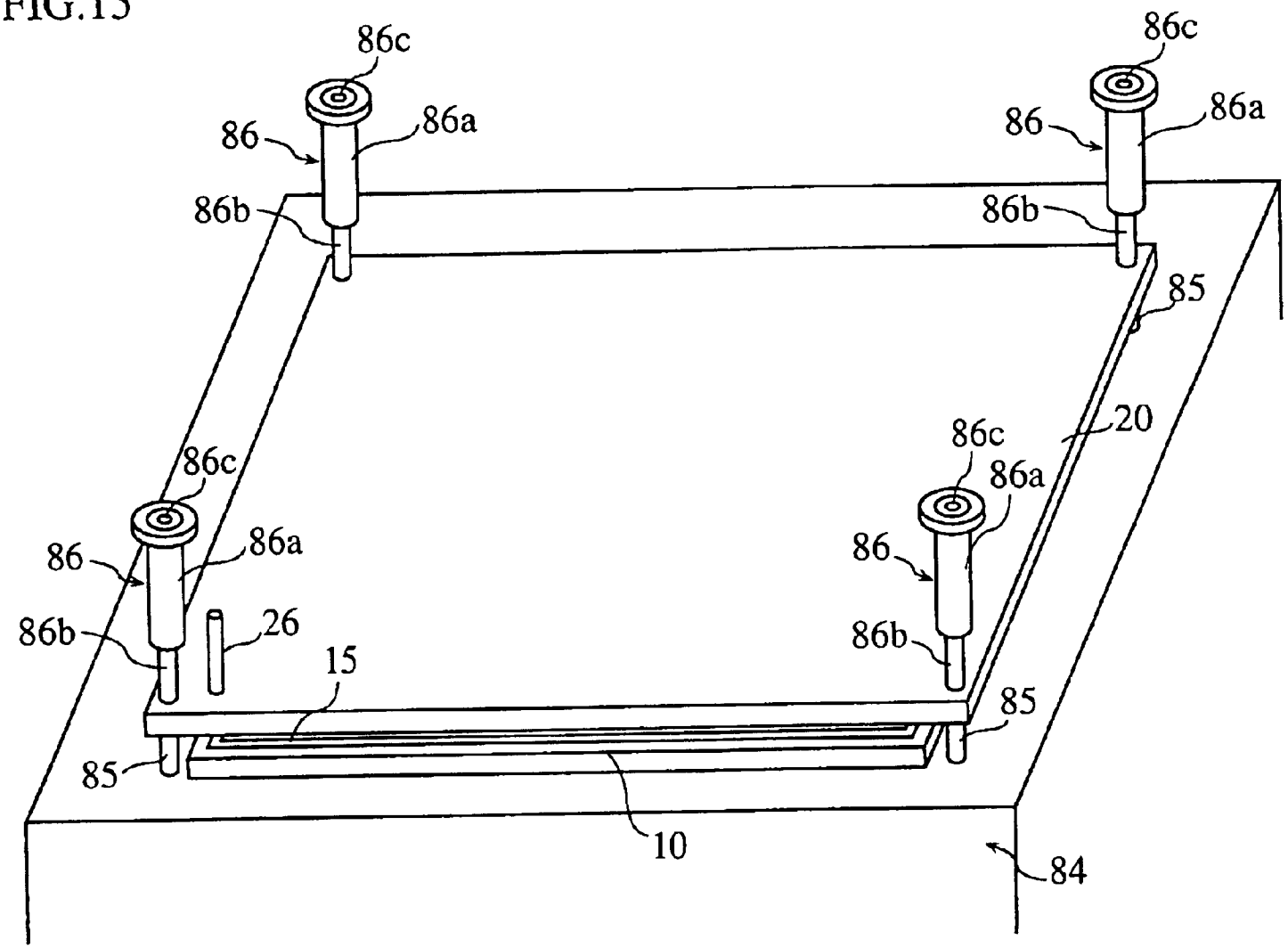
FIG. 15 is a perspective diagram showing the internal construction of the heating/baking apparatus.

FIG. 15 is a perspective diagram showing the internal construction of the heating furnace 81.

In FIGS. 14 and 15, the back panel 20 is placed so that the length of the partition walls is represented as a horizontal line.

As shown in FIGS. 14 and 15, the length of the back panel 20 is greater than that of the front panel 10, both edges of the back panel 20 extending off the front panel 10. Note that the extended parts of the back panel 20 are provided with leads which connect the address electrodes 22 to the activating circuit. The slide pins 85 and the pressing mechanisms 86 are positioned at the four corners of the back panel 20, sandwiching the extended parts of the back panel 20 in between.

The four slide pins 85 protrude from the base 84 and can be simultaneously moved upwards and downwards by a pin hoisting and lowering mechanism (not illustrated).

Each of the four pressing mechanisms 86 is composed of a cylindrical-shaped supporter 86*a* fixed on the ceiling of the heating furnace 81, a slide rod 86*b* which can move upwards and downwards inside the supporter 86*a*, and a spring 86*c* which adds pressure on the slide rod 86*b* downwards inside the supporter 86*a*. With the pressure applied to the slide rod 86*b*, the back panel 20 is pressed downwards by the slide rod 86*b*.

Figure 16A:
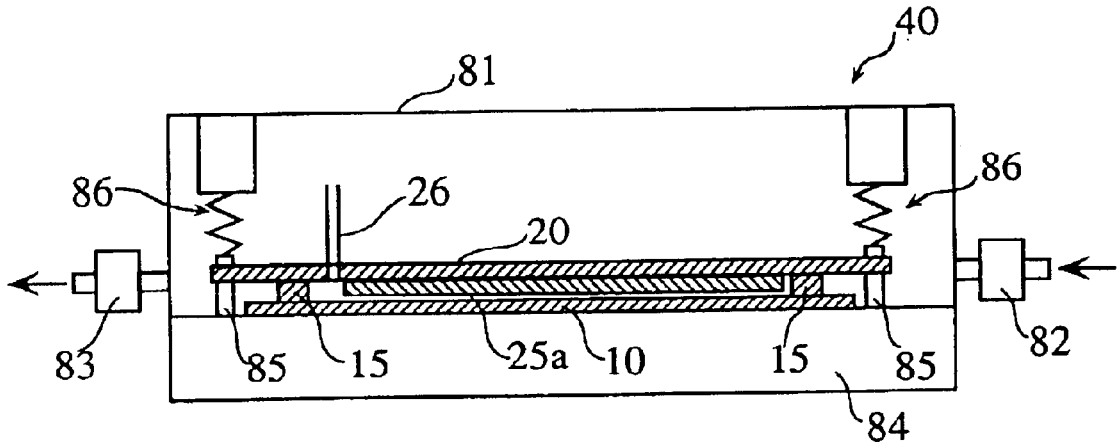
FIGS. 16A to 16C show operations of the heating/baking apparatus.
Figure 16B:
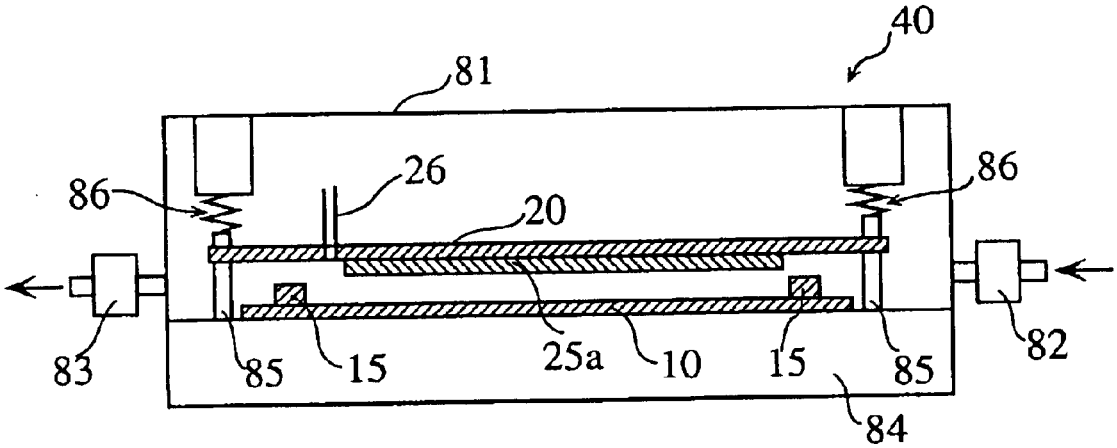
Figure 16C:
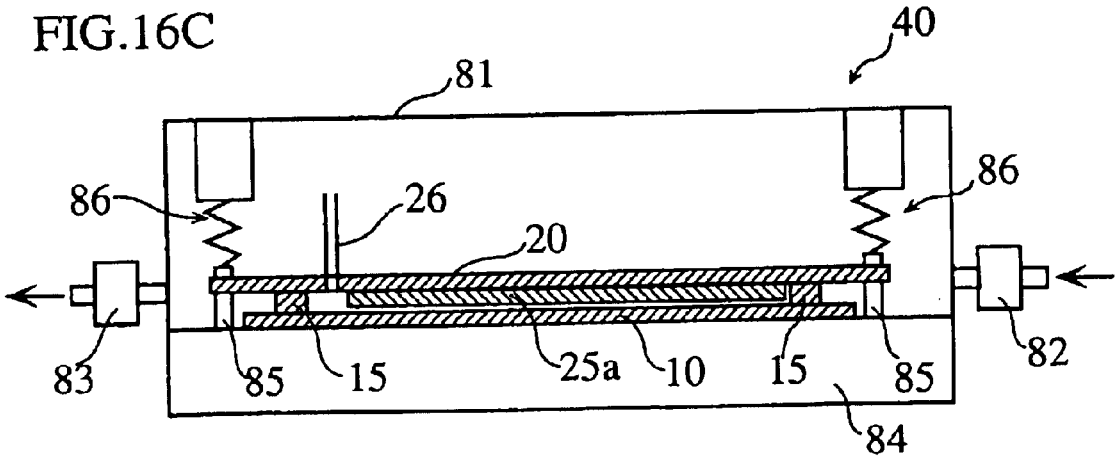
Figure 17A:
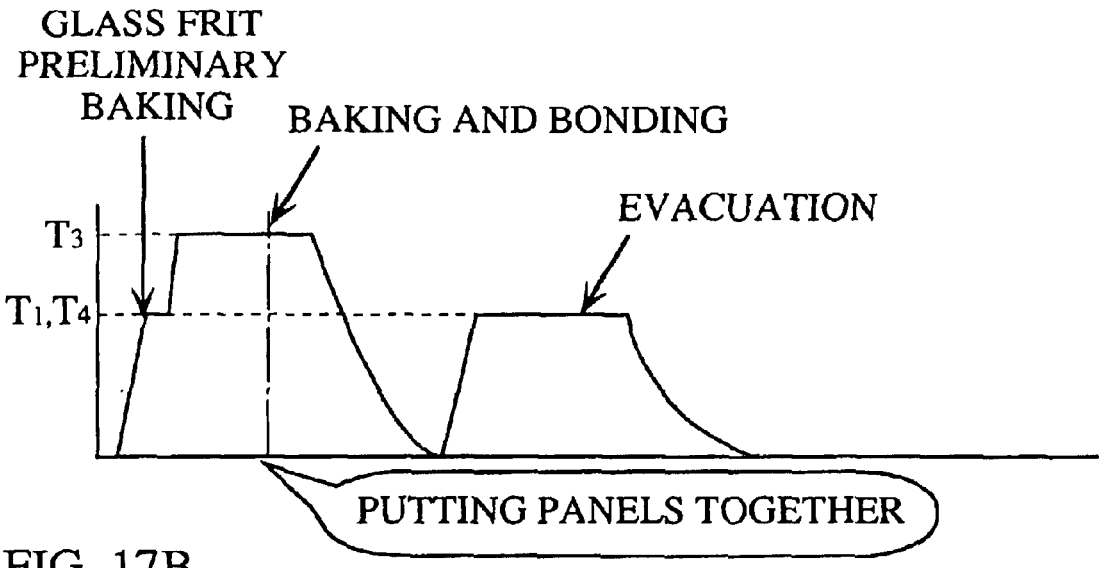
FIGS. 17A and 17B show temperature profiles related to a production method in Embodiment 2.

FIGS. 16A to 16C show operations of the heating/baking apparatus in the preliminary baking, phosphor layer baking, and bonding processes. It is presumed here that these processes are performed based on the temperature profile shown in FIG. 17A.

The sealing glass layer 15 is formed beforehand by applying a paste made of a sealing glass (glass frit) to one of: (a) the outer region of the front panel 10 on a surface that is to face the back panel 20; (b) the outer region of the back panel 20 on a side that is to face the front panel 10; and (c) the outer region of surfaces of the front panel 10 and the back panel 20 that are to face each other (note that in the example shown in FIGS. 16A to 16C, the sealing glass layer 15 is formed on a surface of the front panel 10).

First, the front panel 10 and the back panel 20 are put together after positioned properly. The panels are then laid on the base 84 at a fixed position. The pressing mechanisms 86 are then set to press the back panel 20 (FIG. 16A). Note that to position the panels correctly, it is preferable that positioning markers are formed beforehand on surfaces of the front and back glass substrates 11 and 21, and that the panels are positioned using the positioning markers.

The dry air is then circulated in the heating furnace 81 while the following operations are performed.

The slide pins 85 are hoisted to move the back panel 20 to a position parallel to themselves (FIG. 16B). This broadens the space between the front panel 10 and the back panel 20, and the pre-baking phosphor layers 25*a* on the back panel 20 are exposed to the large space in the heating furnace 81. With the above state of the panels 10 and 20 maintained, the following are performed: (a) the inside of the heating furnace 81 is heated to the frit preliminary baking temperature T1 (e.g., 350° C.) lower than the frit softening point (e.g., 350° C.); (b) the frit preliminary baking temperature T1 is maintained for 10 to 30 minutes to preliminarily bake the sealing glass layer; (c) the inside of the heating furnace 81 is heated to the peak temperature T1 (e.g., 520° C.) higher than the frit softening point; and (d) the peak temperature is maintained for a certain time period.

With the above heating process, the organic binder in the pre-baking phosphor layers 25*a* is burned out, and gases (water or the like) adsorbed on the surfaces of the panels 10 and 20 are released. However, since the pre-baking phosphor layers 25*a* are exposed to a large space in which the dry air is circulated, deterioration of the pre-baking phosphor layers 25*a* is prevented.

The sealing glass layer 15 softens with the above heating. After this, the slide pins 85 are lowered to put the front and back panels 10 and 20 together again. That is, the back panel 20 is reset to its proper position on the front panel 10 (FIG. 16C).

With the pressing mechanism 86, the back panel 20 is pressed onto the front panel 10 for 10 to 20 minutes. The panels are then cooled off. This completes the bonding process. Then the pressing mechanism 86 is dismounted and the bonded substrates are taken out.

As is the case with Embodiment 1, the softening point of the sealing glass frit needs to be lower than the baking temperature (520° C.). In addition, it is desirable that the softening point of the sealing glass frit is higher than 400° C. since the sealing glass with an exceedingly low softening point tends to deform during the baking process.

The exhausting process is performed after the bonding process is performed as above.

In the exhausting process, the gas exhaust is performed using a vacuum pump (not illustrated) connected to a glass pipe 26 which is attached to the air vent 21*a*. After the exhausting process, the discharge gas is enclosed to the internal space between the panels through the glass pipe 26. The PDP is then completed after the air vent 21*a* is plugged and the glass pipe 26 is cut away.

Effects of the Method Shown in the Present Embodiment

As is the case with Embodiment 1, the frit preliminary baking process, phosphor baking process, and bonding process are performed in one process in Embodiment 2. Therefore, compared to conventional methods in which the frit preliminary baking process, phosphor baking process, and bonding process are performed separately, the present method reduces the time and energy required for the production.

Also, deterioration of the phosphors and the protecting layer 14 due to heat is prevented since oxygen required for the burnout of resin in the pre-baking phosphor layers 25*a* is always supplied, and the pre-baking phosphor layers 25*a* and protecting layer 14 are not exposed to high-temperature, high-density gases released from the panels or burning gases.

Variations of Embodiment 2

(1) In Embodiment 2 also, as described in Embodiment 1, glass pipes 26*a* and 26*b* for supplying and exhausting a dry gas may be attached to the panels so that a dry air is circulated in the internal space while the front and back panels 10 and 20 are bonded together. This improves the effect of preventing the phosphors from deteriorating due to heat.

(2) In Embodiment 2, it is possible to perform the exhausting process at some midpoint before the panels are cooled to ambient temperature after the bonding process.

That is to say, it is possible to perform in series the preliminary baking process, the phosphor layer baking process, the bonding process, and the exhausting process in one operation of raising and lowering temperature, based on the temperature profile shown in FIG. 9 or FIG. 10 described in Embodiment 1.

Compared to conventional methods in which the bonding process and the exhausting process are performed separately, the present method further provides the effect of reducing the time and energy required for the production.

More particularly, the preliminary baking, phosphor layer baking, and bonding processes are performed while a pipe 90 inserted from outside the heating furnace 81 is connected to the glass pipe 26 that is attached to the air vent 21*a* formed in the back panel 20, the inside of the heating furnace 81 is cooled to the exhausting temperature T4, then a vacuum pump is connected to the pipe 90 and the exhausting process is performed.

Figure 17B:
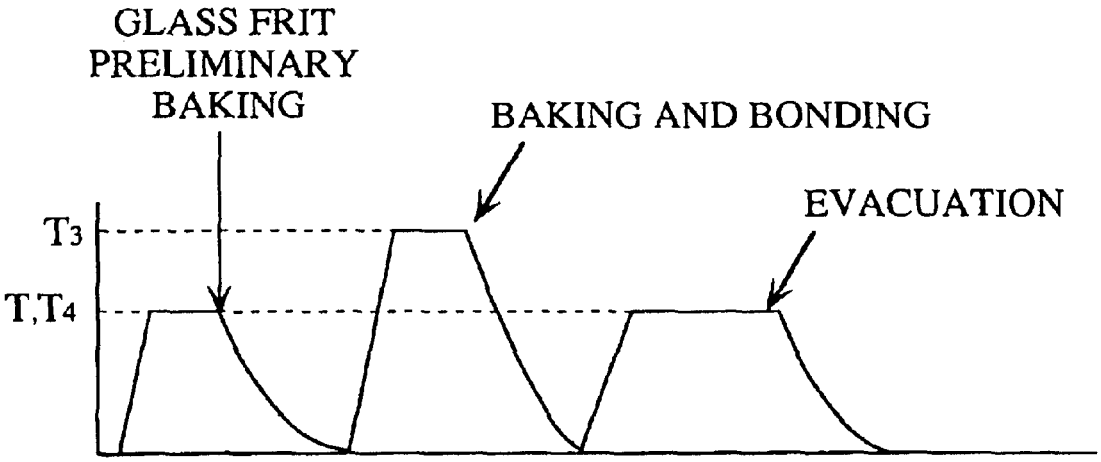

(3) The production processes may be performed based on the temperature profile shown in FIG. 17B. That is to say, the back panel 20 on which the sealing glass layer 15 has been formed in advance is preliminarily baked, then the phosphor baking process and the bonding process are performed in succession using the heating/baking apparatus 80.

In this case, as is the case with a variation of Embodiment 1, though the effect of reducing the time and energy required for the production is less excellent since the preliminary baking process is separately performed, this method contributes to the enhancement of yield since the sealing glass layer is difficult to collapse when the two panels are disposed to face each other.

Figure 18:
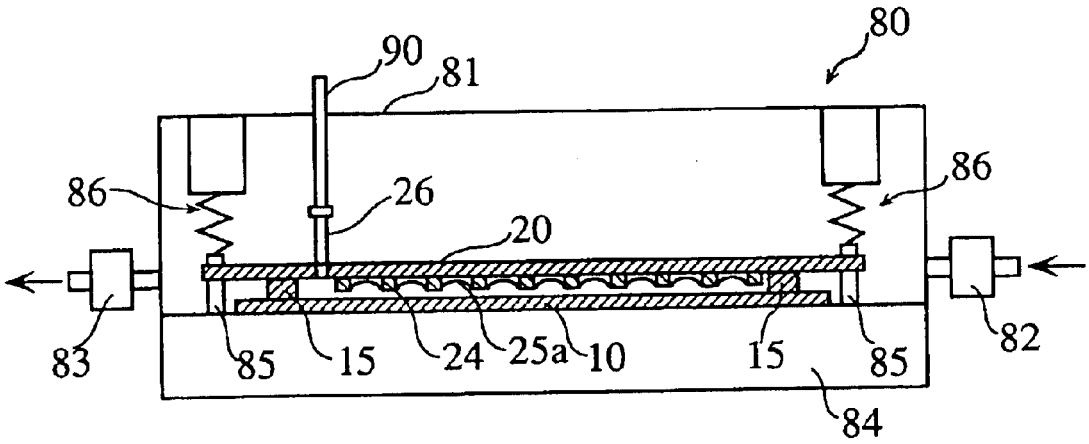
FIG. 18 shows the exhausting process in the production method in a variation of Embodiment 2.

(4) In the examples shown in FIGS. 16 and 18, the front and back panels 10 and 20 are separated or put together by moving the back panel 20 along a certain path. However, as shown in FIGS. 19A to 19C, the front and back panels 10 and 20 may be separated or put together by rotating the back panel 20 so that the back panel 20 is partially separated from the front panel 10 and restored to the initial position.

On the base 84, as in the case shown in FIG. 18, four pins, or a pair of pins 85*a* and a pair of pins 85*b* are formed on the base 84 corresponding to the four corners of the back panel 20. However, the pins 85*a* corresponding to one side (in FIGS. 19A to 19C, on the left-hand side) of the back panel 20, support the back panel 20 at their edges (e.g., the edge of the pin 85*a* formed in a spherical shape is fitted into a spherical pit formed on the back panel 20), while the pins 85*b* corresponding to the other side (in FIGS. 19A to 19C, on the right-hand side) of the back panel 20 are movable upwards and downwards. It should be noted here that it is preferable that the positions on the back panel 20 supported by the pins 85*a* are set at the right or left edge of the back panel shown in FIG. 3 so that the rotation axis becomes parallel to the barrier ribs 24.

Figure 19A:
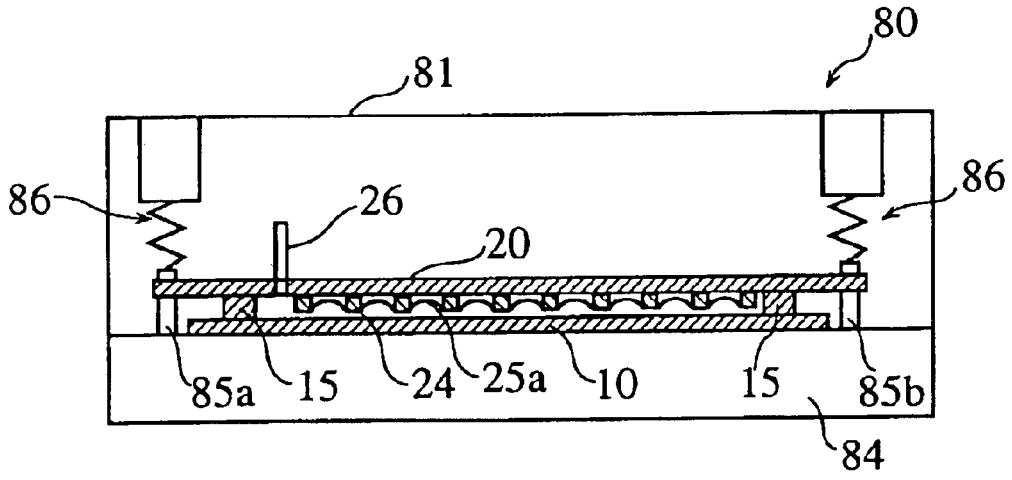
FIGS. 19A to 19C show an operation in a variation of Embodiment 2.
Figure 19B:
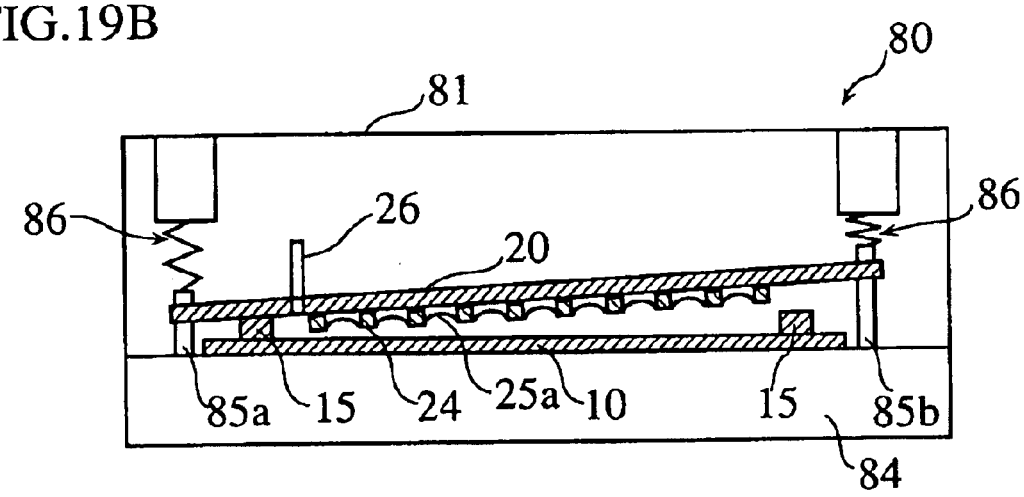
Figure 19C:
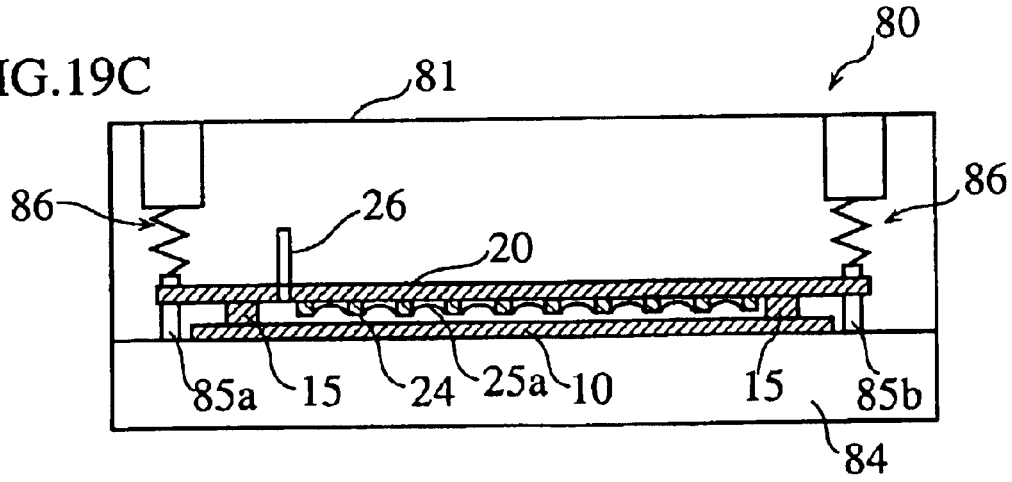
Figure 20:
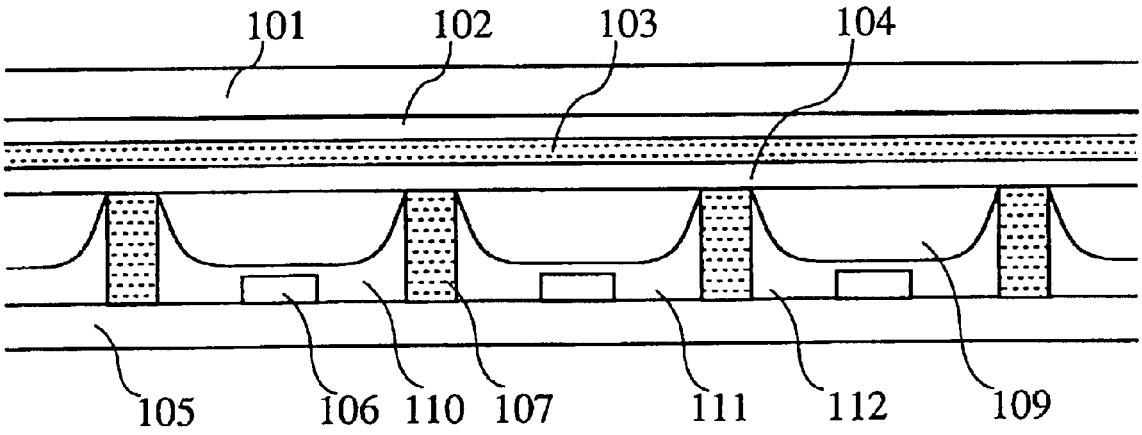
FIG. 20 is a schematic sectional view of a typical AC type PDP.

Also, the heating furnace 81 has an entrance and en exit of the dry air at the front and back of FIGS. 19A to 19C, respectively so that the dry air can be circulated along the barrier ribs 24 in the heating furnace 81 (in a direction toward the front or back of FIGS. 19A to 19C).

In this case, as shown in FIG. 19A, the front panel 10 and the back panel 20 are put together and laid on the base 84 as shown in FIG. 19A. The back panel 20 is rotated about the edge of the pins 85*a* by moving the pins 85*b* upwards as shown in FIG. 19B. This partially separates the back panel 20 from the front panel 10. The back panel 20 is rotated in the reversed direction and restored to the initial position by moving the pins 85*b* downwards as shown in FIG. 19C. That is, the panels 10 and 20 are in the same position as are adjusted properly at first.

The panels 10 and 20 are in contact at the side of pins 85*a* in the stage shown in FIG. 19B. However, gases released from the panels or burning gases are not confined in the internal space since the other side of the panels are open. Also, the dry air is circulated smoothly in the space between the panels.

(5) In Embodiment 2, the front panel 10 and the back panel 20 are put together after positioned properly, the panels are separated by moving the back panel 20 along a certain path, the panels are heated, and the panels are put together by moving the back panel 20 along the path in a reversed direction so that the panels are bonded together. However, positioning markers may be formed beforehand on surfaces of the front and back glass substrates 11 and 21. Also, a camera for detecting the positioning markers when the panels are disposed to face each other may be formed. Furthermore, a mechanism for fine-tuning the position of the back panel 20 may be formed. With this construction, it is possible to position the panels based on the positioning markers when they are heated. This method is preferable because even if the separated panels are shifted when they are heated, the position of the panels can be corrected before they are bonded.

Such a positioning mechanism may be a known one that has already been used in the bonding process in PDP production.

In Embodiment 2, the preliminary baking process, the phosphor layer baking process, and the, bonding process are performed while the dry air is circulated in the heating/baking apparatus 80. However, the dry air may not be circulated. Without circulation of dry air, gases released from the panels or burning gases are not confined when the above processes are performed by heating the front and back panels 10 and 20 while they are separated from each other. This prevents the pre-baking phosphor layers 25*a* and protecting layer 14 from being exposed to high-temperature, high-density gases released from the panels or burning gases, preventing the phosphors from being deteriorated and protecting quality of the protecting layer 14 to some extent. Others In Embodiments 1 and 2, the phosphor layers are formed on the back panel. However, the phosphor layers may be formed on the front panel or on both panels. In any cases, the same effect can be obtained.

The present invention can be achieved by using the phosphors typically used for PDPs other than the phosphors with the composition shown in the above embodiments.

In a typical case, the sealing glass is applied after the phosphor layer is formed, as shown in Embodiments 1 and 2. However, the order of these processes may be reversed.

Embodiments 1 and 2 describe the case where a surface-discharge type PDP is manufactured. However, the present invention can also be applied to the case where an opposed-discharge type PDP or a DC type PDP is manufactured.

The present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A method for producing a plasma display panel that has a front substrate and a back substrate disposed to face each other, the method comprising:

a pre-baking phosphor layer forming step for forming a pre-baking phosphor layer containing a phosphor and an organic binder, on at least one of the surfaces of the front substrate and the back substrate that are to face each other;

a sealing material applying step for applying a sealing material that softens with heat, to the peripheral region of at least one of the surfaces of the front and back substrates that are to face each other;

a stacking step for, after the pre-baking phosphor layer forming step and the sealing material applying step, disposing the front and back substrates to face each other in a stack; and a baking step for heating the front and back substrates to burn out the organic binder while supplying a dry gas containing oxygen to an internal space that is formed between the front and back substrates, wherein the organic binder is burned out and the sealing material is softened to enable bonding of the front and back substrates in a simultaneous operation of raising and lowering temperature.

2. The method of claim 1, wherein at least one of the front and back substrates has thickness of 2 mm or less.

3. The method of claim 1, wherein $BaMgAl_{10}O_{17}$:Eu is used as a phosphor constituting a blue phosphor layer.

4. The method of claim 1, wherein the sealing material is a glass frit that softens at a temperature lower than the highest temperature achieved in the baking step.

5. The method of claim 4, wherein the glass frit has a softening point of 400° C. or higher.

6. The method of claim 4 further comprising a preliminary baking step between the sealing material applying step and the stacking step, wherein in the preliminary baking step, the glass frit is heated to a predetermined temperature to be preliminarily baked.

7. The method of claim 1, wherein the sealing material is a glass frit that is substantially composed of a crystalline glass.

8. The method of claim 7, wherein in the baking step, the heating is suspended for a predetermined time period after a temperature of the front and back substrates reaches to a predetermined temperature, then the heating is resumed to burn out the organic binder.

9. The method of claim 1, wherein a flow rate of the dry gas supplied to the internal space is 1 CCM per 1 $cm^3$ of the internal space.

10. The method of claim 9, wherein a flow rate of oxygen contained in the dry gas supplied to the internal space is 0.5 CCM per 1 $cm^3$ of the internal space.

11. The method of claim 1, wherein in the baking step, the front and back substrates are heated while being secured by pressure applied by a plurality of pressing units attached to the front and back substrates.

12. The method of claim 11, wherein the plurality of pressing units apply pressure to the peripheral region of the front and back substrates.

13. The method of claim 12, wherein the plurality of pressing units apply pressure to the front and back substrates inward of the sealing material, excluding the central region of the front and back substrates.

14. The method of claim 1 further comprising an exhausting step for exhausting gases from the internal space, wherein the exhausting step is started before the front and back substrates cool off to ambient temperature after the baking step.

15. The method of claim 14, wherein the exhausting step is completed before the front and back substrates cool off to ambient temperature after the baking step.

16. The method of claim 15, wherein in the exhausting step, gases are exhausted while the internal space is maintained at a constant temperature.

17. A method for producing a plasma display panel that has a front substrate and a back substrate disposed to face each other, the method comprising:

a pre-baking phosphor layer forming step for forming a pre-baking phosphor layer containing a phosphor and an organic binder, on at least one of surfaces of the front substrate and the back substrate that are to face each other;

a sealing material applying step for applying a sealing material that softens with heat, to the peripheral region of one of the surfaces of the front and back substrates that are to face each other;

a baking step for, after the pre-baking phosphor layer forming step and the sealing material applying step, burning out the organic binder by heating the front and back substrates in a furnace while the surfaces of the front and back substrates are positioned to face each other and are separated from each other to provide enough space to allow gases to escape, from an internal space between the faces of substrates, to outside of the substrates; and a bonding step for disposing the front and back substrates to contact the sealing material for bonding the front and back substrates by keeping the front and back substrates at a temperature higher than the softening point of the sealing material, wherein the organic binder is burned out and the sealing material is softened to enable bonding of the front and back substrates in a simultaneous operation of raising and lowering temperature.

18. The method of claim 17, wherein in the bonding step, after the front and back substrates are disposed to face each other, a dry gas containing oxygen is supplied to an internal space formed between the front and back substrates.

19. The method of claim 17, wherein in the baking step, gases released from the front and back substrates as the substrates are heated are removed forcibly.

20. The method of claim 17, wherein positioning markers are formed on surfaces of the front and back substrates before the baking step, and in the bonding step, the front and back substrates are positioned using the positioning markers so as to face each other.

21. The method of claim 17, wherein the sealing material is a glass frit.

22. The method of claim 21, wherein the glass frit has a softening point of 400° C. or higher.

23. The method of claim 22, wherein in the bonding step, the front and back substrates are heated to a temperature in a range of 400° C. to 520° C.

24. The method of claim 17, wherein in the baking step, the front and back substrates are heated in an atmosphere of a dry gas.

25. The method of claim 24, wherein in the baking step, the front and back substrates are heated in an atmosphere of a circulated dry gas.

26. The method of claim 24, wherein the dry gas used in the baking step contains oxygen.

27. The method of claim 17 further comprising a disposing step and a separating step in succession between the sealing material applying step and the baking step, wherein in the disposing step, the front and back substrates are disposed to face each other, then in the separating step, the front and back substrates are relatively moved apart along a predetermined path, and in the bonding step, the front and back substrates are relatively moved together along the predetermined path so that the front and back substrates are disposed to face each other.

28. The method of claim 27, wherein in the separating step and the bonding step, the front and back substrates are moved parallel to each other.

29. The method of claim 17 further comprising an exhausting step for exhausting gases from the internal space, wherein the exhausting step is started before the front and back substrates cool off to ambient temperature after the bonding step.

30. The method of claim 29, wherein the exhausting step is completed before the front and back substrates cool off to ambient temperature after the baking step.

31. The method of claim 30, wherein in the exhausting step, gases are exhausted while the internal space is maintained at a constant temperature.

32. A plasma display panel production apparatus for use in the baking step and the bonding step in the method of claim 17, comprising:

a heating furnace for housing and heating the front and back substrates disposed to face each other; and a dry gas supplying mechanism for supplying a dry gas to an internal space formed between the front and back substrates.

33. The plasma display panel production apparatus of claim 32 further comprising an exhausting mechanism for exhausting gases from the internal space.

34. A method for producing a plasma display panel that has a front substrate and a back substrate disposed to face each other, the method comprising:

a pre-baking phosphor layer forming step for forming a pre-baking phosphor layer containing a phosphor and an organic binder, on at least one of surfaces of the front substrate and the back substrate that are to face each other;

a sealing material applying step for applying a sealing material that softens with heat, to the peripheral region of one of the surfaces of the front and back substrates that are to face each other;

a disposing step wherein the front and back substrates are disposed to face each other;

a separating step wherein the front and back substrates are relatively moved apart along a predetermined path;

a baking step for, after the pre-baking phosphor layer forming step and the sealing material applying step, burning out the organic binder by heating the front an back substrates in a furnace while the surfaces of the front and back substrates are positioned to face each other and are separated from each other to provide enough space to allow gases to escape, from an internal space between the faces of substrates, to outside of the substrates; and a bonding step for disposing the front and back substrates to contact the sealing material for bonding the front and back substrates by relatively moving the front and back substrates together along the predetermined path so that the front and back substrates are disposed to face each other while keeping the front and back substrates at a temperature higher than the softening point of the sealing material.

35. The method of claim 34, wherein in the separating step and the bonding step, the front and back substrates are moved parallel to each other.

* * * * *

UNITED STATES PATENT AND TRADEMARK OFFICE

CERTIFICATE OF CORRECTION

PATENT NO. : 6,860,780 B2
DATED : March 1, 2005
INVENTOR(S) : Kanako Miyashita et al.

It is certified that error appears in the above-identified patent and that said Letters Patent is hereby corrected as shown below:

Column 22,
Line 47, after the word "front" delete "an" and insert -- and --.

Signed and Sealed this

Seventh Day of June, 2005

JON W. DUDAS
*Director of the United States Patent and Trademark Office*